US010205290B2

(12) United States Patent
Tsai

(10) Patent No.: US 10,205,290 B2
(45) Date of Patent: Feb. 12, 2019

(54) ELECTRICAL CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 15/551,494

(22) PCT Filed: Feb. 17, 2016

(86) PCT No.: PCT/CN2016/073916
§ 371 (c)(1),
(2) Date: Aug. 16, 2017

(87) PCT Pub. No.: WO2016/131423
PCT Pub. Date: Aug. 25, 2016

(65) Prior Publication Data

US 2018/0026410 A1 Jan. 25, 2018

(30) Foreign Application Priority Data

Feb. 17, 2015 (CN) ..... 2015 2 0113880 U
Oct. 27, 2015 (CN) ..... 2015 2 0837119 U
Dec. 11, 2015 (CN) ..... 2015 2 1031383 U

(51) Int. Cl.
*H01R 24/60* (2011.01)
*H01R 13/502* (2006.01)
(Continued)

(52) U.S. Cl.
CPC ..... *H01R 24/60* (2013.01); *H01R 13/502* (2013.01); *H01R 13/6583* (2013.01);
(Continued)

(58) Field of Classification Search
CPC .. H01R 24/60; H01R 13/502; H01R 13/6587; H01R 13/6594; H01R 2107/00;
(Continued)

(56) References Cited

U.S. PATENT DOCUMENTS

2016/0104972 A1* 4/2016 Feng ..... H01R 13/6581
439/607.27

* cited by examiner

*Primary Examiner* — Tulsidas C Patel
*Assistant Examiner* — Travis Chambers
(74) *Attorney, Agent, or Firm* — WPAT, PC

(57) ABSTRACT

An electrical connector comprises: an insulated seat provided with a base seat and a docking part, wherein the docking part is connected to a front end of the base seat, the docking part is provided with two connection plates facing each other in a vertical direction, each of opposite facing surfaces of the two connection plates is provided with a connection surface, and a connection slot is formed between the two connection surfaces; two terminal sets disposed on the insulated seat, wherein each of the terminal sets is provided with at least one row of terminals, the terminal is provided with a fixing portion and an extension, the fixing portion is fixed to the base seat, the extension extends to a connection plate and is provided with a contact projecting beyond the connection surface, the contact is vertically elastically movable, the contacts of the terminals of the two terminal sets respectively project from the two connection surfaces to the connection slot; and a metal housing covering the insulated seat; characterized in that a metallic inner shell is further provided between the metal housing and the docking part, the metallic inner shell rests against the metal housing, and each of left and right side plates of the metallic inner shell is integrally provided with a projecting resilient snap projecting toward the connection slot.

19 Claims, 25 Drawing Sheets

(51) Int. Cl.

| | |
|---|---|
| ***H01R 13/6587*** | (2011.01) |
| ***H01R 13/6594*** | (2011.01) |
| ***H01R 13/6583*** | (2011.01) |
| ***H01R 13/6597*** | (2011.01) |
| *H01R 107/00* | (2006.01) |
| *H01R 13/6585* | (2011.01) |

(52) U.S. Cl.
CPC ..... *H01R 13/6587* (2013.01); *H01R 13/6594* (2013.01); *H01R 13/6597* (2013.01); *H01R 13/6585* (2013.01); *H01R 2107/00* (2013.01)

(58) Field of Classification Search
CPC ..... H01R 13/6585; H01R 13/6582; H01R 13/6583; H01R 13/6593
USPC ..... 439/607.09, 607.05, 607.17, 607.19, 439/607.27
See application file for complete search history.

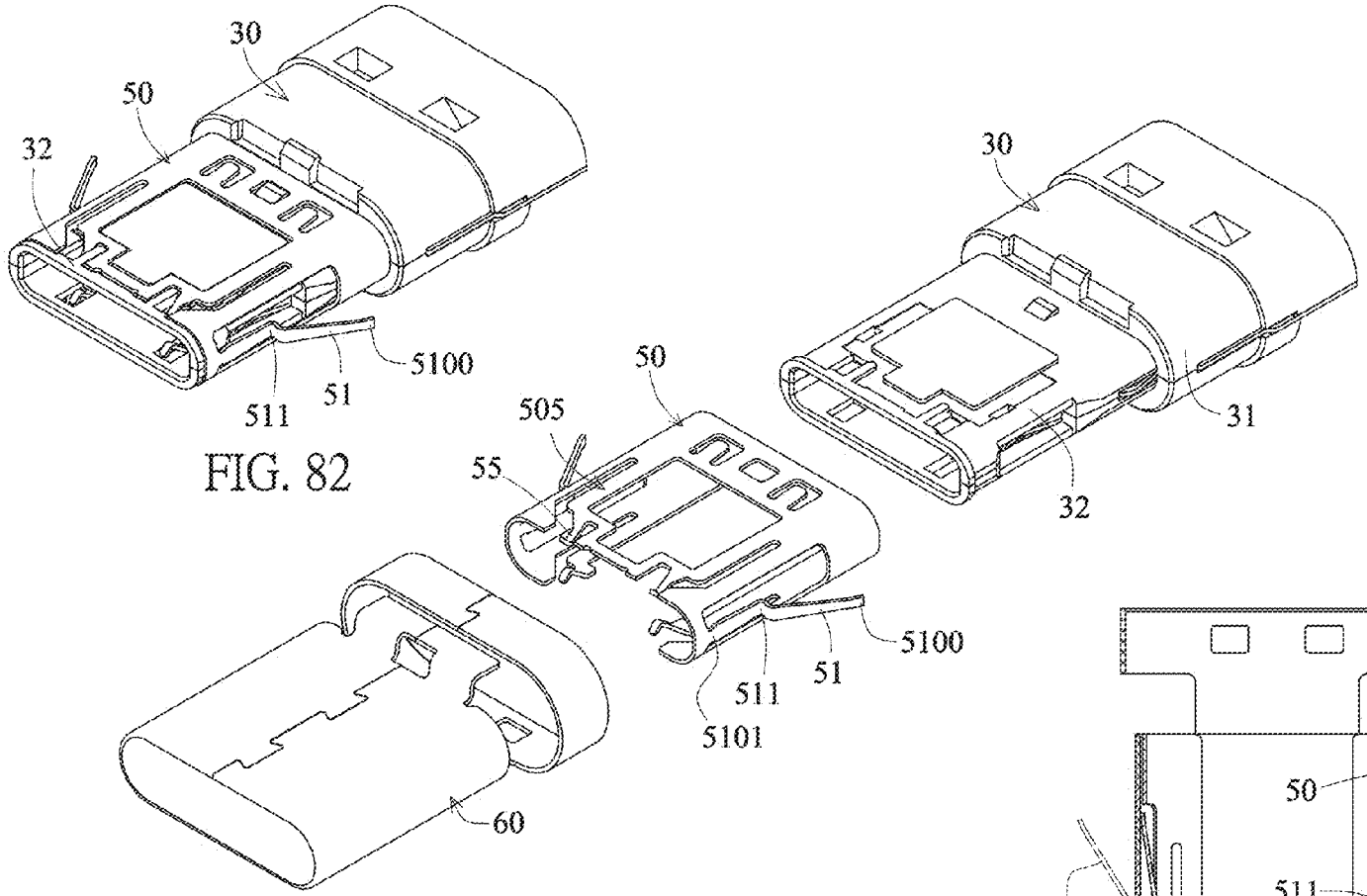
FIG. 81
FIG. 82
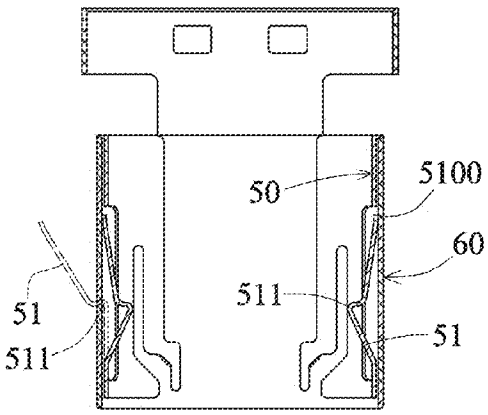
FIG. 83

ELECTRICAL CONNECTOR

BACKGROUND OF THE INVENTION

Field of the Invention

The invention relates to an electrical connector, and more particularly to an electrical connector with dual-position bidirectional docking.

Description of the Related Art

The new generations of interfaces are gradually developed to follow the specification of the USB TYPE-C electrical connector as the mainstream specification. This is because that the USB TYPE-C electrical connector can achieve the dual-position bidirectional docking and the convenience in use. However, the metal housing of the USB TYPE-C electrical connector cannot be pressed to form a snap structure and a grounding structure. That is, the snap structure and the grounding structure are additionally disposed inside in the form of metal plate sheets.

The snap structure of the conventional USB TYPE-C electrical connection plug is substantially integrally connected to two sides of a metal partition plate, or two separate resilient snaps are respectively disposed in a plastic seat so that the assembling becomes more inconvenient. Regarding the grounding structure, two separate metal grounding sheets are respectively provided with elastic contact sheets, and the two metal grounding sheets are respectively positioned outside upper and lower plates of a docking part. Such the configuration is not the good design.

In view of this, the inventor continuously performs the research and improvement to develop the better snap structure and grounding structure to achieve the better function and the easily manufacturing.

SUMMARY OF THE INVENTION

A main object of the invention is to provide an electrical connector, wherein each of left and right side plates of its metallic inner shell is integrally provided with a resilient snap, the snap structure can be simplified and the electrical connector can be easily processed and assembled.

Another main object of the invention is to provide an electrical connector, wherein the metallic inner shell thereof is integrally provided with upper and lower plates and is provided with at least one elastic contact sheet, and an elastic arm of the elastic contact sheet slantingly extends forwards and projects toward a connection slot. The elastic contact sheet is provided with a projecting contact and has a front end being a free end in a form of a guide-in inclined surface. Thus, upper and lower elastic contact sheets can be integrally provided, and the elastic arm of the elastic contact sheet has the longer arm of force.

Another main object of the invention is to provide an electrical connector, which is provided with metallic and separated upper and lower plates. Each of the upper and lower plates is integrally provided with at least one twisted contact piece. The twisted contact piece is provided with a twisted elastic sheet extending in a left-to-right direction. The twisted elastic sheet is integrally connected to at least one elastic contact sheet. The twisted elastic sheet can be reversely twisted or elastically moved relatively to the elastic contact sheet, so that the elastic contact sheet has the excellent resilience.

Another main object of the invention is to provide an electrical connector, which is provided with at least one metallic twisted contact piece. The twisted contact piece is provided with a twisted elastic sheet extending in a left-to-right direction. The twisted elastic sheet is integrally connected to at least one elastic contact sheet. The twisted elastic sheet can be reversely twisted or elastically moved relatively to the elastic contact sheet, so that the elastic contact sheet has the excellent resilience.

Another main object of the invention is to provide an electrical connector, wherein its metallic inner shell is integrally provided with upper and lower plates, each of the upper and lower plates is integrally provided with at least one twisted contact piece, the twisted contact piece is provided with a twisted elastic sheet extending in a left-to-right direction, and the twisted elastic sheet is integrally connected to at least one elastic contact sheet. The twisted elastic sheet can be reversely twisted or elastically moved relatively to the elastic contact sheet, so that the elastic contact sheet has the excellent resilience.

Another secondary object of the invention is to provide an electrical connector, wherein the metallic inner shell is integrally provided with upper and lower plates and left and right side plates, and each of front ends of the upper and lower plates is provided with at least one elastic contact sheet, each of the left and right side plates is integrally provided with a resilient snap so that it is possible to integrally provide the left and right snap structures and the upper and lower grounding structures and that the manufacturing and assembling are simplified.

Another secondary object of the invention is to provide an electrical connector, wherein a width of a root connected to the elastic contact sheet and the twisted elastic sheet is reduced to form two concave portions, so that the twisted elastic sheet has the better twist resilience.

Another secondary object of the invention is to provide an electrical connector, wherein two twisted supporting elastic sheets are in flat surface contact with and rest against the connection plate and the metal housing to prevent the twisted elastic sheet from becoming too soft and tending to be twisted and deformed, and the middle elastic contact sheet still has the sufficient normal contact force.

Another secondary object of the invention is to provide an electrical connector, and the convex surface of the docking part has the thicker structure to form the bouncing space for the distal end of the terminal.

Another secondary object of the invention is to provide an electrical connector, wherein each of front ends of the left and right sides of one of the upper and lower plates of the metallic inner shell is provided with a horizontal material bridge, the material bridge has a front edge in a form of an electroless layer section and a rear edge in a space-providing inclined surface, and the space-providing inclined surface provides a space for a deployed length of the elastic contact sheet, so that in the pressing fabrication, the metallic inner shell can be connected to a material tape through the material bridge and then be pressed and bent.

Another secondary object of the invention is to provide an electrical connector, wherein the twisted supporting elastic sheet is in flat surface contact with and rests against the metal housing and can be twisted with the twisted elastic sheet to prevent the twisted elastic sheet from becoming too soft and tending to be twisted and deformed, and that the middle elastic contact sheet still has the sufficient normal contact force.

Another secondary object of the invention is to provide an electrical connector, wherein an elastic arm of the elastic contact sheet may have the smaller curved inclination to prevent the elastic contact sheet from shrinking, kneeing down or falling down upon use.

Another secondary object of the invention is to provide an electrical connector, wherein the twisted elastic sheet is integrally connected to at least two elastic contact sheets, the twisted elastic sheet is wound between the two elastic contact sheets to form a U-shaped elastic arm, the twisted elastic sheet increases the twisted elastic arm of force, and the U-shaped elastic arm also has the middle section supporting effect, so that the middle section of the twisted elastic sheet can be supported and cannot become too soft to be twisted and deformed, and that the middle elastic contact sheet still has the sufficient normal contact force.

Another secondary object of the invention is to provide an electrical connector, wherein the arc tangent portion of at least one of left and right sides of the top and bottom plate surfaces of the metallic inner shell are pressed to form at least one through hole or a pre-cut groove, so that the arc-shaped left and right side plates can be easily bent.

Another secondary object of the invention is to provide an electrical connector, wherein the portion of the left and right side plates of the metallic inner shell thereof connected to the resilient snap is provided with a material-pulling punch hole extending in a top-to-bottom direction, so that the resilient snap can be easily drawn from the left and right side plates to prevent the elastic arm of the resilient snap from becoming thin and hard.

Another secondary object of the invention is to provide an electrical connector, wherein each of ends of the resilient snap of the left and right side plates of the metallic inner shell is a root connected to the metallic inner shell, the other end thereof is open to form a free end, and the free end rests against the metal housing, so that the resilient snap may have the better resilient contact.

Another secondary object of the invention is to provide an electrical connector, wherein the front end of the resilient snap of the left and right side plates of the metallic inner shell is a root connected to the metallic inner shell and the rear end thereof is open to form a free end, and when the metallic inner shell and the metal housing are not assembled together, the rear section portion in back of the snap of the resilient snap of the metallic inner shell projects beyond the metallic inner shell, so that when the metallic inner shell is assembled with the insulated seat from front to rear, the two resilient snaps are less likely to interfere with the insulated seat and can be easily assembled.

To achieve the above-identified object, the invention provides an electrical connector, comprising: an insulated seat provided with a base seat and a docking part, wherein the docking part is connected to a front end of the base seat, the docking part is provided with two connection plates facing each other in a vertical direction with a gap between the two connection plates, each of opposite facing surfaces of the two connection plates is provided with a connection surface, and a connection slot is formed between the two connection surfaces; two terminal sets disposed on the insulated seat, wherein each of the terminal sets is provided with at least one row of terminals, the terminal is provided with a fixing portion and an extension, the fixing portion is fixed to the base seat, the extension is connected to a front end of the fixing portion, the extension extends to the connection surface and is provided with a contact projecting beyond the connection surface, the contact is vertically elastically movable, and the contacts of the terminals of the two terminal sets respectively project beyond the two connection surfaces; and a metal housing, which covers the insulated seat and is provided with a four-sided main housing shielding the docking part to form a docking structure, wherein the docking structure may be positioned with one docking electrical connector; characterized in that a metallic inner shell is further provided between the metal housing and the docking part, the metallic inner shell is fitted with and positioned outside the docking part and rests against the metal housing, each of left and right side plates of the metallic inner shell is integrally projectingly provided with a resilient snap projecting toward the connection slot, and the two resilient snaps may snap with the docking electrical connector.

In the electrical connector, the metallic inner shell is a metal plate sheet integrally bent to form upper and lower plates and the left and right side plates.

In the electrical connector, each of the upper and lower plates of the metallic inner shell is provided with at least one elastic contact sheet, an elastic arm of the elastic contact sheet is provided with a projecting contact, the contact projects beyond the connection surface to the connection slot and is disposed in front of the contact of the terminal, each of the two connection plates of the docking part is provided with at least one opening through which the contact of the elastic contact sheet passes.

In the electrical connector, each of front sections of the upper and lower plates is integrally provided with at least one twisted contact piece, the twisted contact piece is provided with a twisted elastic sheet extending in a left-to-right direction, the twisted elastic sheet is integrally connected to the elastic contact sheet, one plate surface of the twisted elastic sheet rests against and is in flat surface contact with a rest surface and a twisting space is provided in a direction of another plate surface of the twisted elastic sheet, wherein when the elastic contact sheet is vertically elastically movable, the twisted elastic sheet can be twisted in a direction reverse to an elastically moving direction of the elastic contact sheet through the twisting space.

In the electrical connector, the elastic arm of the elastic contact sheet extends frontwards and slantingly projects toward the connection slot, and the elastic contact sheet is provided with a projecting contact and has a front end being a free end in a form of a guide-in inclined surface.

In the electrical connector, each of the upper and lower plates is integrally provided with at least one twisted contact piece, the twisted contact piece is provided with a twisted elastic sheet extending in a left-to-right direction, the twisted elastic sheet is integrally connected to at least one elastic contact sheet, the elastic contact sheet is provided with a projecting contact projecting beyond the connection surface to the connection slot and being disposed in front of the contact of the terminal, each of the two connection plates of the docking part is provided with at least one opening through which the contact of the elastic contact sheet passes, a plate surface of the twisted elastic sheet rests against and is in flat surface contact with a rest surface, and a twisting space is provided in a direction of another plate surface of the twisted elastic sheet, wherein when the elastic contact sheet is vertically elastically movable, the twisted elastic sheet can be twisted in a direction reverse to an elastically moving direction of the elastic contact sheet through the twisting space.

In the electrical connector, an elastic arm of the elastic contact sheet extends frontwards and slantingly projects toward the connection slot, and the elastic contact sheet is provided with a projecting contact and has a front end being a free end in a form of a guide-in inclined surface.

The electrical connector satisfies one of (a) to (j) or a combination of more than one of (a) to (j):

(a) wherein each of top and bottom ends of the left and right side plates of the metallic inner shell is integrally provided with at least one elastic contact sheet, an elastic arm of the elastic contact sheet is provided with a projecting contact, the contact projects beyond the connection surface to the connection slot and is disposed in front of the contact of the terminal, and each of the two connection plates of the docking part is provided with at least one opening through which the contact of the elastic contact sheet passes;

(b) wherein the metallic inner shell comprises separated left and right housings, the left housing forms the left side plate, and the right housing forms the right side plate;

(c) wherein the left and right side plates of the metallic inner shell are formed by pressing a plate surface and are integrally bent to form the resilient snap;

(d) wherein front and rear ends of the two elastic sheets of the two resilient snaps are integrally connected to the left and right side plates, each of the middle sections of the two resilient snaps is provided with a more inwardly projecting snap, and widths of the elastic sheets of the resilient snaps gradually reduce from the front and rear ends to the snap;

(e) wherein the docking part is further provided with left and right side plates to form a fitting frame body, and two side plates of the docking part are respectively provided with two openings through which the two resilient snaps pass;

(f) wherein the two ends of the elastic sheets of the two resilient snaps are integrally connected to the left and right side plates, each of the middle sections of the two resilient snaps is provided with a more inwardly projecting snap, inclinations from two rear ends of the two elastic sheets of the two resilient snaps to the two elastic sheets of the two snaps are greater than inclinations from two front ends of the two elastic sheets of the two resilient snaps to the two elastic sheets of the two snaps;

(g) wherein one of the front and rear ends of the two elastic sheets of the two resilient snaps is integrally connected to the left and right side plates, the other one of the front and rear ends of the two elastic sheets of the two resilient snaps is open to form a free end, each of the two middle sections of the two elastic sheets of the two resilient snaps is provided with a more inwardly projecting snap, and the free end rests against the metal housing;

(h) wherein the two elastic sheets of the two resilient snaps have two front ends integrally connected to the left and right side plates, and two rear ends open to form free ends, each of the two middle sections of the two elastic sheets of the two resilient snaps is provided with a more inwardly projecting snap, and the free end rests against the metal housing in an overpressure manner;

(i) wherein the two elastic sheets of the two resilient snaps have two front ends integrally connected to the left and right side plates, and two rear ends open to form free ends, each of the two middle sections of the two elastic sheets of the two resilient snaps is provided with a more inwardly projecting snap, and the free end rests against the metal housing in an overpressure manner, wherein when the metallic inner shell and the metal housing are not assembled and fitted together, a rear section portion in back of the resilient snap projects beyond the metallic inner shell; and (j) wherein two ends of elastic sheets of the two resilient snaps are integrally connected to the left and right side plates, each of middle sections of the two resilient snaps is provided with a more inwardly projecting snap, each of the left and right side plates is provided with a material-pulling punch hole extending in a top-to-bottom direction near a portion connected to the resilient snap.

The invention further provides an electrical connector, comprising: an insulated seat provided with a base seat and a docking part, wherein the docking part is connected to a front end of the base seat, the docking part is provided with two connection plates facing each other in a vertical direction to form a gap, each of opposite facing surfaces of the two connection plates is provided with a connection surface, and a connection slot is formed between the two connection surfaces; two terminal sets disposed on the insulated seat, wherein each of the terminal sets is provided with at least one row of terminals, the terminal is provided with a fixing portion and an extension, the fixing portion is fixed to the base seat, the extension is connected to a front end of the fixing portion, the extension extends to the connection surface and is provided with a contact projecting beyond the connection surface, the contact is vertically elastically movable, and the contacts of the terminals of the two terminal sets respectively project beyond the two connection surfaces; and a metal housing, which covers the insulated seat and is provided with a four-sided main housing shielding the docking part to form a docking structure, wherein the docking structure may be bidirectionally positioned with one docking electrical connector; characterized in that a metallic inner shell is further provided between the metal housing and the docking part, the metallic inner shell is fitted with and positioned outside the two connection plates of the docking part and rests against the metal housing, the metallic inner shell is provided with integrally connected upper and lower plates, each of the upper and lower plates is provided with at least one elastic contact sheet, an elastic arm of the elastic contact sheet extends frontwards and slantingly projects toward the connection slot, the elastic contact sheet is provided with a projecting contact and has a front end being a free end in a form of a guide-in inclined surface, the contact projects beyond the connection surface to the connection slot and is disposed in front of the contact of the terminal, and each of the two connection plates of the docking part is provided with at least one opening through which the contact of the elastic contact sheet passes.

The invention further provides an electrical connector, comprising: an insulated seat provided with a base seat and a docking part, wherein the docking part is connected to a front end of the base seat, the docking part is provided with two connection plates facing each other in a vertical direction to form a gap, each of opposite facing surfaces of the two connection plates is provided with a connection surface, and a connection slot is formed between the two connection surfaces; two terminal sets disposed on the insulated seat, wherein each of the terminal sets is provided with at least one row of terminals, the terminal is provided with a fixing portion and an extension, the fixing portion is fixed to the base seat, the extension is connected to a front end of the fixing portion, the extension extends to the connection surface and is provided with a contact projecting beyond the connection surface, the contact is vertically elastically movable, and the contacts of the terminals of the two terminal sets respectively project beyond the two connection surfaces; and a metal housing, which covers the insulated seat and is provided with a four-sided main housing shielding the docking part to form a docking structure, wherein the docking structure may be positioned with one docking electrical connector; characterized in that a metallic inner shell is further provided between the metal housing and the docking part, the metallic inner shell is fitted with and positioned outside the two connection plates of the docking part and rests against the metal housing, the metallic inner shell is provided with integrally connected upper and lower plates, each of the upper and lower plates is integrally provided with at least one twisted contact piece, the twisted contact piece is provided with a twisted elastic sheet extending in a left-to-right direction, the twisted elastic sheet is integrally connected to at least one elastic contact sheet, the elastic contact sheet is provided with a projecting contact projecting beyond the connection surface to the connection slot and being disposed in front of the contact of the terminal, each of the two connection plates of the docking part is provided with at least one opening through which the contact of the elastic contact sheet passes, and a plate surface of the twisted elastic sheet rests against and is in flat surface contact with a rest surface, and a twisting space is provided in a direction of another plate surface of the twisted elastic sheet, wherein when the elastic contact sheet is vertically elastically movable, the twisted elastic sheet can be twisted in a direction reverse to an elastically moving direction of the elastic contact sheet through the twisting space.

In the electrical connector, an elastic arm of the elastic contact sheet extends frontwards and slantingly projects toward the connection slot, and the elastic contact sheet is provided with a projecting contact and has a front end being a free end in a form of a guide-in inclined surface.

In the electrical connector, each of front ends of left and right sides of one of the upper and lower plates of the metallic inner shell is provided with a horizontal material bridge, the material bridge has a front edge in a form of an electroless layer section and a rear edge in a form of a space-providing inclined surface, and the space-providing inclined surface provides a space for a deployed length of the elastic contact sheet.

In the electrical connector, a middle of the base seat of the insulated seat is provided with a horizontal metal partition plate for separating the two terminal sets from each other.

The electrical connector satisfies one of (a) to (d) or a combination of more than one of (a) to (d):

(a) wherein the left and right sides of the metal partition plate extend backwards to form pins extending out of the base seat;

(b) wherein two outer terminals of the two terminal sets are ground terminals, and the two ground terminals are provided with projections resting against the metal partition plate;

(c) wherein two outer terminals of the two terminal sets are ground terminals, and the ground terminal is provided with a projection resting against the metallic inner shell; and (d) wherein the left and right sides of the metal partition plate are provided with projections resting against the metallic inner shell.

In the electrical connector, two sides of a rear end of the metallic inner shell are provided with backward extending pins, which pass through the base seat of the insulated seat and extend out, wherein the pins of the metallic inner shell may be bonded to a circuit board and grounded.

In the electrical connector, each of the upper and lower plates of the metallic inner shell is connected and provided with the two elastic contact sheets, a middle section of the top plate is formed with an opening extending in a front-to-rear direction and only has two side portions, each of the two side portions is connected to the one twisted contact piece, and the twisted contact piece is connected to the one elastic contact sheet In the electrical connector, the twisted elastic sheet of the twisted contact piece of each of two side portions of the top plate is connected and provided with an elastic arm extending in a front-to-rear direction, the bottom plate is only integrally provided with a twisted contact piece, the twisted elastic sheet of the twisted contact piece is integrally connected to the two elastic contact sheets and each of the left and right sides of the twisted contact piece is provided with an elastic arm extending in a front-to-rear direction.

The invention further provides an electrical connector, comprising: an insulated seat provided with a base seat and a docking part, wherein the docking part is connected to a front end of the base seat, the docking part is provided with two connection plates facing each other in a vertical direction to form a gap, each of opposite facing surfaces of the two connection plates is provided with a connection surface, and a connection slot is formed between the two connection surfaces; two terminal sets disposed on the insulated seat, wherein each of the terminal sets is provided with at least one row of terminals, the terminal is provided with a fixing portion and an extension, the fixing portion is fixed to the base seat, the extension is connected to a front end of the fixing portion, the extension extends to the connection surface and is provided with a contact projecting beyond the connection surface, and the contact is vertically elastically movable, and the contacts of the terminals of the two terminal sets respectively project beyond the two connection surfaces; and a metal housing, which covers the insulated seat and is provided with a four-sided main housing shielding the docking part to form a docking structure, wherein the docking structure may be bidirectionally positioned with one docking electrical connector; characterized in that between the metal housing and the docking part is further provided with metallic upper and lower plates, the upper and lower plates are separated from each other in a vertical direction and are respectively connected to and positioned outside the two connection plates of the docking part and rest against the metal housing, each of the upper and lower plates is integrally provided with at least one twisted contact piece, the twisted contact piece is provided with a twisted elastic sheet extending in a left-to-right direction, the twisted elastic sheet is integrally connected to at least one elastic contact sheet, the elastic contact sheet is provided with a projecting contact projecting beyond the connection surface to the connection slot and being disposed in front of the contact of the terminal, each of the two connection plates of the docking part is provided with at least one opening through which the contact of the elastic contact sheet passes, a plate surface of the twisted elastic sheet rests against and is in flat surface contact with a rest surface, and a twisting space is provided in a direction of another plate surface of the twisted elastic sheet, wherein when the elastic contact sheet is vertically elastically movable, the twisted elastic sheet can be twisted in a direction reverse to an elastically moving direction of the elastic contact sheet through the twisting space.

In the electrical connector, an elastic arm of the elastic contact sheet extends frontwards and slantingly projects toward the connection slot, and the elastic contact sheet is provided with a projecting contact and has a front end being a free end in a form of a guide-in inclined surface.

The electrical connector satisfies one of (a) to (h) or a combination of more than one of (a) to (h):

(a) wherein a width of a root connected to the elastic contact sheet and the twisted elastic sheet is reduced to form two concave portions;

(b) wherein the twisted elastic sheet is disposed on the same plane and integrally connected to and provided with at least one twisted supporting elastic sheet, and the twisted supporting elastic sheet extends frontwards and can be twisted with the twisted elastic sheet;

(c) wherein the twisted elastic sheet is disposed on the same plane and integrally connected to and provided with at least one twisted supporting elastic sheet, the twisted supporting elastic sheet extends frontwards and can be twisted with the twisted elastic sheet, and a front end of the twisted supporting elastic sheet is in a form of an electroless layer section and extends out of the elastic contact sheet;

(d) wherein the rest surface is the metal housing;

(e) wherein at least one of the left and right sides of the twisted elastic sheet is connected to an elastic arm extending in a front-to-rear direction;

(f) wherein the twisted elastic sheet is integrally connected to two or three copies of the elastic contact sheet, each of the two connection plates of the docking part is provided with two openings each being the same as the opening or three openings each being the same as the opening through which the contact of the elastic contact sheet passes;

(g) wherein the two connection plates of the docking part are provided with a concave portion for providing a space for twisting of the twisted elastic sheet, the twisted elastic sheet forms the twisting space by the concave portion, and the concave portion is a slot or a through hole; and (h) wherein each of the left and right sides of the twisted elastic sheet is provided with an elastic arm extending in a front-to-rear direction, wherein the two connection plates of the docking part are provided with two slots for providing spaces for twisting of the twisted elastic sheets and two through holes for providing spaces for twisting of the two elastic arms, and the twisted elastic sheets form the twisting space by the slots and the through holes.

In the electrical connector, each of the front sections of the upper and lower plates of the metallic inner shell is provided with an opening, the two connection plates corresponding to the openings may project thicker to form two convex surfaces and thus to form bouncing spaces of distal ends of the terminals The electrical connector satisfies one of (a) to (l) or a combination of more than one of (a) to (l):

(a) wherein the contacts of the two terminal sets have the same contact interface;

(b) wherein the four-sided main housing of the metal housing is top-bottom symmetrical and left-right symmetrical;

(c) wherein the two terminal sets and the insulated seat are embedded with, injection molded with and fixed to each other;

(d) wherein the contacts of the two terminal sets having connection points with the same circuit serial numbers are arranged reversely;

(e) wherein the contacts of the two terminal sets are vertically aligned;

(f) wherein the two connection plates have the same height;

(g) wherein the electrical connector is further provided with a coating for covering a rear section of the metal housing;

(h) wherein the base seat of the insulated seat is provided with the upper and lower base seats directly stacked, the docking part is integrally formed with a rectangularly-shaped fitting frame body and is fit and assembled with the front end of the base seat, and the two terminal sets are respectively fixedly disposed on the upper and lower base seats;

(i) wherein the insulated seat is provided with upper and lower seat bases directly stacked, the upper seat base is integrally provided with an upper base seat and an upper docking part, the lower seat base is integrally provided with a lower base seat and a lower docking part, the upper docking part has an inverse-U shaped frame body, the lower docking part has an U-shaped frame body, the upper and lower docking parts are stacked to form a rectangularly-shaped fitting frame body, and the two terminal sets are respectively fixedly disposed on the upper and lower seat bases;

(j) wherein the docking part is further provided with left and right side plates to form a fitting frame body;

(k) wherein each of the two connection plates is provided with one row of separate bouncing spaces much more depressed than the connection surface and is provided with separation columns for separating the neighboring bouncing spaces, and the extensions of the at least one row of terminals of the two terminal sets respectively extend to the bouncing spaces of two connection surfaces and are vertically elastically movable; and (l) wherein a shape of the docking structure is such that the docking structure can be dual-positionally bidirectionally positioned with one docking electrical connector.

The electrical connector satisfies one of (a) to (b) or a combination of more than one of (a) to (b):

(a) wherein a root of the elastic contact sheet is provided with a vertical section, and the vertical section is connected to the slantingly and forwardly extending elastic arm, so that the elastic arm and the root form a turning step; and (b) wherein a distal section of the elastic contact sheet is inwardly and reversely bent to form the contact.

In the electrical connector, a middle of the base seat of the insulated seat is provided with a horizontal metal partition plate for separating the two terminal sets from each other, each of the left and right sides of the metal partition plate is provided with a resilient snap, the resilient snap is provided with an elastic arm, the elastic arm is provided a protruding snap projecting toward the connection slot near a free end of the elastic arm, and the two resilient snaps may snap with the docking electrical connector.

The invention further provides an electrical connector, comprising: an insulated seat provided with a base seat and a docking part, wherein the docking part is connected to a front end of the base seat and is provided with at least one connection surface; and a metal housing, which covers the insulated seat and is provided with a four-sided main housing shielding the docking part to form a docking structure, wherein the docking structure may be positioned with one docking electrical connector; characterized in that the electrical connector is provided with at least one metallic twisted contact piece, the twisted contact piece is positioned at the insulated seat, the twisted contact piece is provided with a twisted elastic sheet extending in a left-to-right direction, the twisted elastic sheet is integrally connected to at least one elastic contact sheet, a plate surface of the twisted elastic sheet rests against and is in flat surface contact with a rest surface, and a twisting space is provided in a direction of another plate surface of the twisted elastic sheet, when the elastic contact sheet is vertically elastically movable, the twisted elastic sheet can be twisted in a direction reverse to an elastically moving direction of the elastic contact sheet through the twisting space, and the elastic contact sheet is provided with a projecting contact projecting beyond the connection surface.

The electrical connector satisfies one of (a) to (k) or a combination of more than one of (a) to (k):

(a) wherein a width of a root connected to the elastic contact sheet and the twisted elastic sheet is reduced to form two concave portions;

(b) wherein the twisted elastic sheet is disposed on the same plane and integrally connected to and provided with at least one twisted supporting elastic sheet, and the twisted supporting elastic sheet extends frontwards and can be twisted with the twisted elastic sheet;

(c) wherein the twisted elastic sheet is disposed on the same plane and integrally connected to and provided with at least one twisted supporting elastic sheet, the twisted supporting elastic sheet extends frontwards and can be twisted with the twisted elastic sheet, and a front end of the twisted supporting elastic sheet is in a form of an electroless layer section;

(d) wherein at least one of the left and right sides of the twisted elastic sheet is connected to an elastic arm extending in a front-to-rear direction;

(e) wherein the twisted elastic sheet is integrally connected to one, two or three of the elastic contact sheets;

(f) wherein the twisted contact piece is a grounding piece;

(g) wherein a shape of the docking structure is such that the docking structure can be dual-positionally bidirectionally positioned with one docking electrical connector;

(h) wherein the at least one twisted contact piece integrally extends and connects to a positioning portion positioned with the insulated seat;

(i) wherein the at least one twisted contact piece integrally extends and connects to a positioning portion positioned with the insulated seat and integrally extends and connects to a pin extending out of the metal housing and the insulated seat;

(j) wherein an elastic arm of the elastic contact sheet extends frontwards and has a front end being a free end in a form of a guide-in inclined surface; and (k) wherein the rest surface is the metal housing.

In the electrical connector, the twisted elastic sheet is integrally connected to at least two elastic contact sheets, and the twisted elastic sheet is wound between the two elastic contact sheets to form a U-shaped elastic arm.

The electrical connector satisfies one of (a) to (c) or a combination of more than one of (a) to (c):

(a) wherein the twisted elastic sheet is integrally connected to two or three copies of the elastic contact sheet;

(b) wherein the front end of the U-shaped elastic arm is in a form of an electroless layer section; and (c) wherein the U-shaped elastic arm is wound frontwards.

The electrical connector may be one of (a) and (b):

(a) wherein an arc tangent portion of at least one of left and right sides of top and bottom plate surfaces of the metallic inner shell is pressed to form at least one through hole; and (b) wherein an arc tangent portion of an inner surface of at least one of left and right sides of the top and bottom plate surfaces has a V-shaped pre-cut groove in a front view along a tangent line, wherein the V-shaped pre-cut groove extends in a front-to-rear direction.

With the above-mentioned structure, the invention has the following advantages.

1. Each of left and right side plates of the metallic inner shell is integrally provided with a resilient snap, the snap structure can be simplified, and the electrical connector can be easily processed and assembled.

2. The metallic inner shell is integrally provided with upper and lower plates and provided with at least one elastic contact sheet, an elastic arm of the elastic contact sheet slantingly extends forwards and projects toward the connection slot, and the elastic contact sheet is provided with a projecting contact and has a front end being a free end in a form of a guide-in inclined surface, so that the upper and lower elastic contact sheets can be integrally provided and the elastic arm of the elastic contact sheet has the longer arm of force.

3. The metallic and separated upper and lower plates are provided, each of the upper and lower plates is integrally provided with at least one twisted contact piece, the twisted contact piece is provided with a twisted elastic sheet extending in a left-to-right direction, and the twisted elastic sheet is integrally connected to at least one elastic contact sheet. The twisted elastic sheet can be reversely twisted or elastically moved relatively to the elastic contact sheet, so that the elastic contact sheet has the excellent resilience.

4. The metallic inner shell is integrally provided with upper and lower plates, each of the upper and lower plates is integrally provided with at least one twisted contact piece, the twisted contact piece is provided with a twisted elastic sheet extending in a left-to-right direction, and the twisted elastic sheet is integrally connected to at least one elastic contact sheet. The twisted elastic sheet can be reversely twisted or elastically moved relatively to the elastic contact sheet, so that the elastic contact sheet has the excellent resilience.

5. The metallic inner shell is integrally provided with upper and lower plates and left and right side plates, each of front ends of the upper and lower plates is provided with at least one elastic contact sheet, and each of the left and right side plates is integrally provided with a resilient snap so that it is possible to integrally provide the left and right snap structures and the upper and lower grounding structures and that the manufacturing and assembling are simplified.

6. A width of a root connected to the elastic contact sheet and the twisted elastic sheet is reduced to form two concave portions, so that the twisted elastic sheet has the better twist resilience.

7. The twisted supporting elastic sheet is in flat surface contact with and rests against the connection plate and the metal housing to prevent the twisted elastic sheet from becoming too soft and tending to be twisted and deformed, and that the middle elastic contact sheet still has the sufficient normal contact force.

8. The convex surface of the docking part has the thicker structure to form the bouncing space for the distal end of the terminal.

9. Each of front ends of the left and right sides of one of the upper and lower plates of the metallic inner shell is provided with a horizontal material bridge, the material bridge has a front edge in a form of an electroless layer section and a rear edge in a form of a space-providing inclined surface, and the space-providing inclined surface provides a space for a deployed length of an elastic contact sheet, so that in the pressing fabrication, the metallic inner shell can be connected to a material tape for being pressed and bent through the material bridge 58.

10. An elastic arm of the elastic contact sheet may have the smaller curved inclination to prevent the elastic contact sheet from shrinking, kneeing down or falling down upon use.

11. The twisted elastic sheet is integrally connected to at least two elastic contact sheets, the twisted elastic sheet is wound between the two elastic contact sheets to form a U-shaped elastic arm, the twisted elastic sheet increases the twisted elastic arm of force, and the U-shaped elastic arm also has the middle section supporting effect, so that the middle section of the twisted elastic sheet can be supported and cannot become too soft to be twisted and deformed, and that the middle elastic contact sheet still has the sufficient normal contact force.

12. At least one arc tangent portion of left and right sides of the top and bottom plate surfaces of the metallic inner shell is pressed to form at least one through hole or a pre-cut groove, so that the arc-shaped left and right side plates can be easily bent.

13. A portion of the left and right side plates connected to the resilient snap is provided with a material-pulling punch hole extending in a top-to-bottom direction, so that the resilient snap can be easily drawn from the left and right side plates to prevent the elastic arm of the resilient snap from becoming thin and hard.

14. One end of the resilient snap 51 of the left and right side plates of the metallic inner shell is a root connected to the metallic inner shell and the other end thereof is open to form a free end, and the free end rests against the metal housing, so that the resilient snap may have the better resilient contact.

15. The front end of the resilient snap of the left and right side plates of the metallic inner shell is a root connected to the metallic inner shell and the rear end thereof are open to form free ends. When the metallic inner shell and the metal housing are not assembled together, the rear section portion in back of the snap of the resilient snap of the metallic inner shell projects beyond the metallic inner shell, Thus, when the metallic inner shell is assembled with the insulated seat from front to rear, the two resilient snaps are less likely to interfere with the insulated seat and can be easily assembled.

The above-mentioned and other objects, advantages and features of the invention will become more fully understood from the detailed description of the preferred embodiments given hereinbelow and the accompanying drawings.

BRIEF DESCRIPTION OF THE DRAWINGS

FIG. 81 is a pictorially exploded view according to the 52nd embodiment of the invention.

FIG. 82 is a pictorially assembled view showing a metallic inner shell and an insulated seat according to the 52nd embodiment of the invention.

FIG. 83 is a top combination view showing the metallic inner shell and the metal housing according to the 52nd embodiment of the invention.

DETAILED DESCRIPTION OF THE INVENTION

Figures 1, 1A, 2, 3:
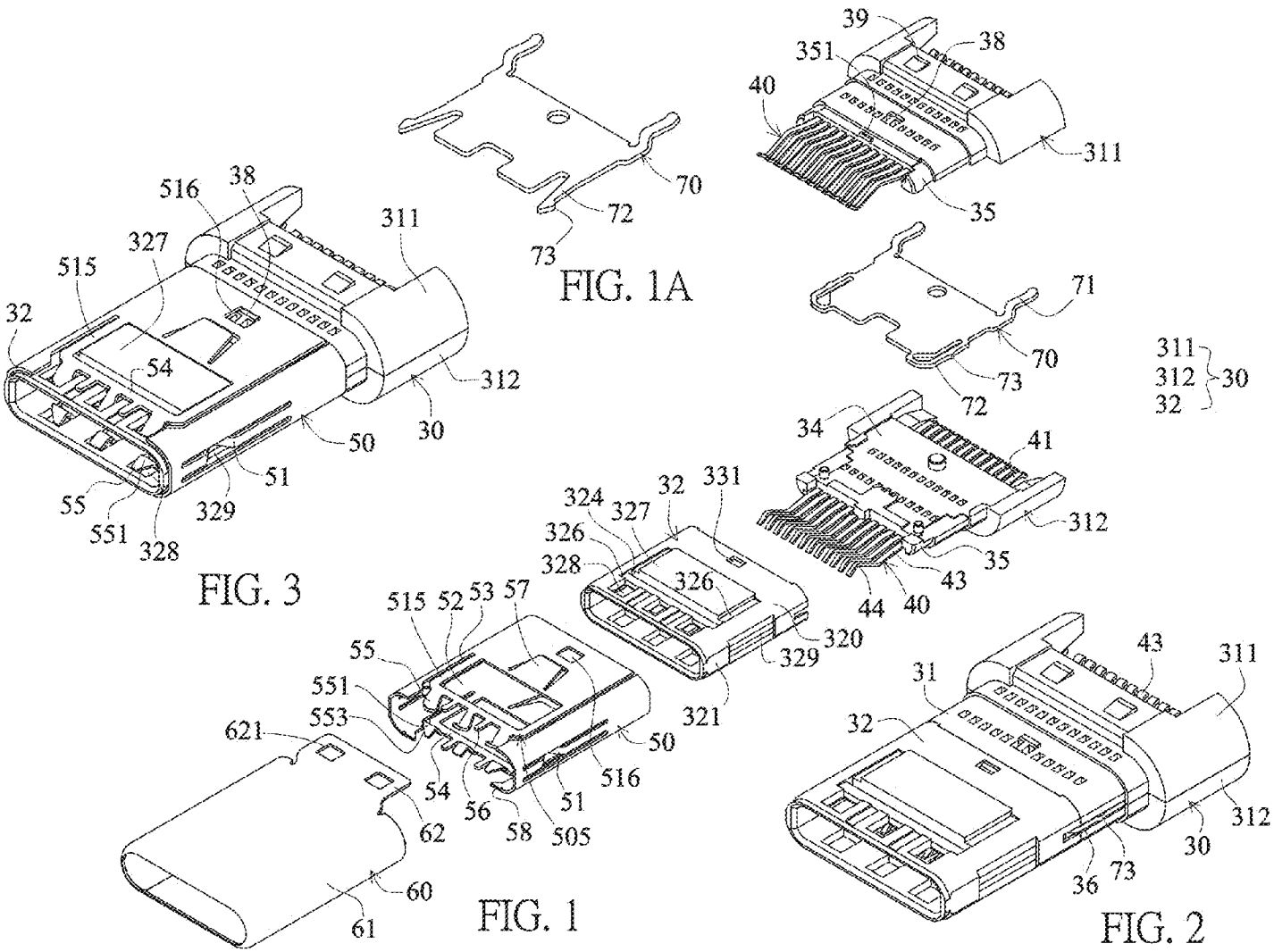
FIG. 1 is a pictorially exploded view according to the first embodiment of the invention.
FIG. 1A is pictorial view showing another implementation of the metal partition plate according to the first embodiment of the invention.
FIG. 2 is a partially pictorially assembled view according to the first embodiment of the invention.
FIG. 3 is a partially pictorially assembled view according to the first embodiment of the invention.
Figure 6:
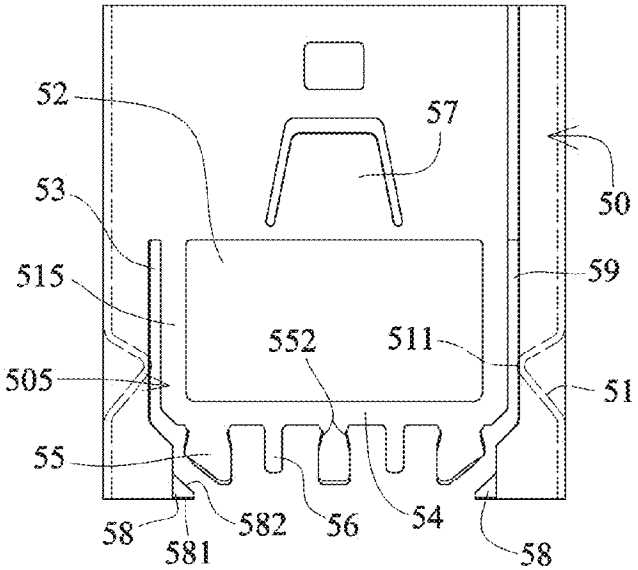
FIG. 6 is a top view showing the metallic inner shell according to the first embodiment of the invention.
Figure 7:
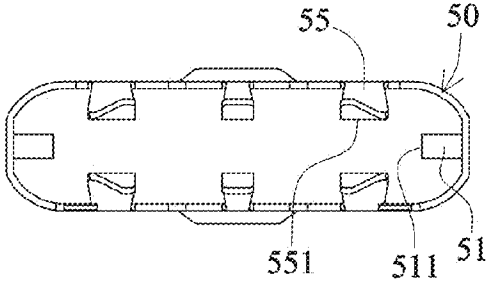
FIG. 7 is a front view showing the metallic inner shell according to the first embodiment of the invention.
Figure 4:
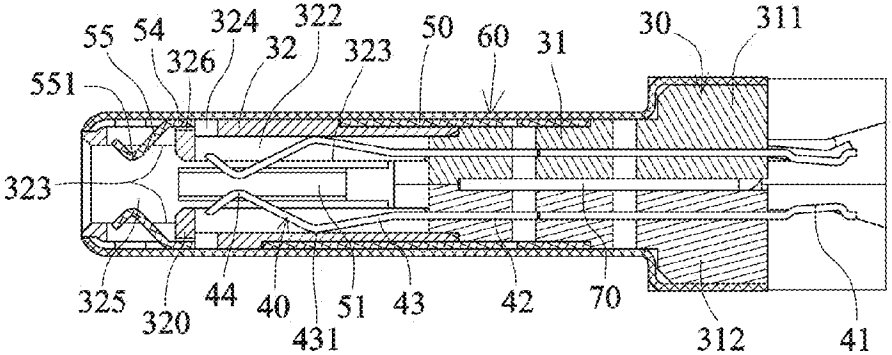
FIG. 4 is a cross-sectional side view according to the first embodiment of the invention.

Please refer to FIGS. 1 to 7, a first embodiment of the invention is a USB TYPE-C 3.0 electrical connection plug, which is provided with an insulated seat 30, two terminal sets, a metallic inner shell 50, a metal housing 60 and a metal partition plate 70.

The insulated seat 30 is provided with a base seat 31 and a docking part 32. The base seat 31 is provided with an upper base seat 311 and a lower base seat 312 direct stacked vertically, and a rear section of the base seat 31 is higher and wider than a front section thereof. The front end of the base seat is provided with a jointing portion 35, two sides of the jointing portion 35 are provided with frontwardly projecting arc-shaped side portions, a notch is formed between the two side portions, each of top and bottom surfaces of a middle section of the jointing portion 35 is provided with an engagement block 351, and each of top and bottom surfaces of the front section of the base seat 31 is provided with an engagement block 38.

The docking part 32 is integrally formed with a rectangularly-shaped fitting frame body and is fit and assembled with the front end of the base seat 31, approximates a rectangular fitting frame body having a flat shape and two sides arced, is provided with two connection plates 320 facing each other in a vertical direction and having the same height and is provided with two side plates 321 connected to the two connection plates 320 to form a fitting frame body, so that a front end of the docking part 32 is an inserting port and a rear end of the docking part 32 is one set of interfaces. Opposite facing surfaces of the two connection plates 320 are two connection surfaces 323 in opposite directions. A connection slot 325 is formed between the two connection surfaces 323. Each of the rear sections of the inner surfaces of the two connection plates 320 is provided with a row of spaced separation columns to provide separation to form a row of bouncing spaces 322. Opposite facing surfaces of the two rows of separation columns are rear sections of the two connection surfaces 323, the row of bouncing spaces 322 are much more depressed than the rear sections of the two connection surfaces 323 and have bottom surfaces separated from the metal housing 60. So, the front sections of the two connection surfaces 323 are lower than the rear sections thereof, so that the height of the connection slot 325 is such that the front section is higher than the rear section. Each of the two connection plates 320 is provided with an engagement hole 331 near the middle of the rear end, and each of the front ends is provided with three openings 328. Each of two side plates thereof is provided with an opening 329. In addition, each of the middles of the two connection plates 320 is provided with a convex surface 327, the front, left and right sides of the convex surface 327 are provided with a much more depressed slot 326. The convex surface 327 has a thicker structure to form a bouncing space 324 of the distal end of the terminal, and the bouncing space 324 is a through hole.

The set of interfaces of the rear end of the docking part 32 is fitted with the jointing portion 35 of the base seat 31, and the engagement hole 331 engages with the engagement block 351.

Figure 5:
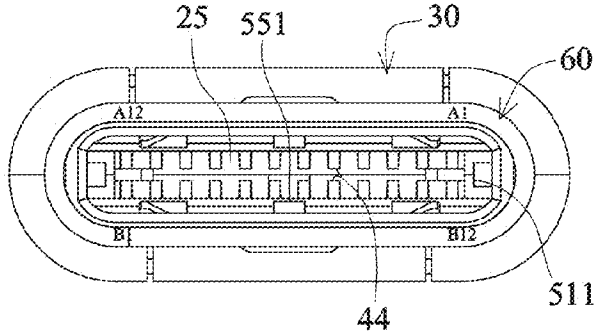
FIG. 5 is a front view according to the first embodiment of the invention.

The two terminal sets having a row of 12 first terminals 40 and the first base seat 311 are embedded into and injection molded with each other, and the row of 12 first terminals 40 and the first base seat 311 are embedded into and injection molded with each other. Each first terminal 40 is sequentially provided with a pin 41, a fixing portion 42 and an extension 43 from one end to the other end, the fixing portion 42 is fixed to the base seat 31, the extension 43 is connected to the front end of the fixing portion 42, extends to the front of the base seat 31, is covered by the docking part 32 and vertically elastically movable in the bouncing space 322, and the portion of the extension 43 near the front end thereof is curved and projectingly provided with a contact 44. The contact 44 projects from the rear section of the connection surface 323 to the connection slot 325. The middle section of the extension 43 is provided with a fulcrum 431 resting against the bottom surface of the bouncing space 322 of the connection plate 320. The pin 41 is connected to the rear end of the fixing portion 42 and extends out of the rear end of the base seat 31. The contacts of the two rows of first terminals 40 having the same circuit serial numbers are arranged reversely, as shown in FIG. 5, the contacts 44 of the lower terminal set have the connection points with the circuit serial numbers arranged, from left to right, as B1 to B12, and the contacts 44 of the upper terminal set have the connection points with the circuit serial numbers arranged, from left to right, as A12 to A1, wherein the contacts of the two terminal sets have the same contact interface and have the connection points with the same circuit serial numbers arranged reversely. The contacts of the two terminal sets are vertically aligned, and the contacts of the two terminal sets are arranged in an equally spaced manner.

The fulcrums 431 of the extensions 43 of the two rows of first terminals 40 rest against the connection plate 320 (that is, rest against the bottom surface of the bouncing space), so that the elastically movable arm has the high structural strength and the good resilience, and the contact 44 has the larger normal force.

The metal partition plate 70 is assembled with the concave surface 34 of the junction surface between the first and second base seats 311 and 312, positioned between the first and second base seats 311 and 312, and disposed at the exact middle of the base seat 31 to separate the two terminal sets. Each of left and right sides of the metal partition plate 70 is integrally extended backwards to form a pin 71 and each of the left and right sides of the plate surface is pressed to form an elastic sheet 72. The elastic sheet 72 projects outwards to form a projection 73. The projection 73 projects beyond openings 36 of the left and right sides of the front section of the base seat (as shown in FIG. 2).

The metallic inner shell 50 is provided with upper and lower plates and left and right side plates to form a four-sided housing. The four-sided housing is a metal plate sheet integrally bent to form the four-sided structure and a seam 59 on the top surface. Each of the left and right side plates of the metallic inner shell is formed by pressing the plate surface and is integrally bent inwardly to form a resilient snap 51. Two ends of each of the elastic sheets of the two resilient snaps 51 are integrally connected to the left and right side plates. Each of middle sections of the two resilient snaps is provided with a more inwardly projecting snap 511. Each of the upper and lower plates is integrally provided with a twisted contact piece 505. The twisted contact piece 505 is a grounding piece and is electrically connected to the metal housing 60. Each of the front sections of the upper and lower plates is provided with an opening 52. The opening 52 is the positioning portion to be locked to the insulated seat 30. Each of the left and right sides of the opening 52 is provided with an open slot 53 and the seam 59, so that the twisted contact piece 505 is formed in front of the opening 52. The twisted contact piece 505 is provided with a twisted elastic sheet 54 extending in a left-to-right direction. Each of the left and right sides of the twisted elastic sheet 54 is provided with an elastic arm 515. The front end of the twisted elastic sheet 54 is integrally connected with three elastic contact sheets 55 and two twisted supporting elastic sheets 56. The elastic arm of the elastic contact sheet 55 slantingly extends forwards and projects inwards. The elastic contact sheet 55 is provided with a contact 551 projecting most inwards and has a front end being a free end and in the form of a guide-in inclined surface 553. The width of a root connected to the elastic contact sheet 55 and the twisted elastic sheet 54 is reduced to form two concave portions 552, so that the twisted elastic sheet 54 has the better twist resilience. The two twisted supporting elastic sheets 56 and the twisted elastic sheet 54 are on the same plane, extend frontwards and are respectively disposed between the two elastic contact sheets 55. Each of the rear sections of the upper and lower plates is provided with an elastic sheet 57 and an engagement hole 516. Each of the front ends of the left and right sides of one of the upper and lower plates is provided with a horizontal material bridge 58. The front edge of the material bridge 58 is in an electroless layer section 581 and the rear edge thereof is in a space-providing inclined surface 582. The space-providing inclined surface 582 provides a space for the deployed length of an elastic contact sheet 53. Upon pressing fabrication, the metallic inner shell 50 is connected to a material tape through the material bridge 58 for being pressed and bent.

The metallic inner shell 50 is fitted and assembled with the outside of the docking part 32. The engagement hole 516 engages with the engagement block 38. The openings 52 of the upper and lower plates engage with the convex surface 327 of the docking part 32. The two twisted supporting elastic sheets 56, the twisted elastic sheet 54 and the elastic arm 515 are correspondingly assembled into the slot 326. The contacts 551 of the elastic contact sheets 55 of the upper and lower plates respectively project beyond the front sections of the two connection surfaces 323 from the openings 28 of the docking part 32. The contacts of the two terminal sets 44 are disposed in back of the contacts 551 of the elastic contact sheets 55 of the upper and lower plates and are nearer to the center height of the connection slot 325 than the contact 551. The resilient snaps 51 of the left and right side plates of the metallic inner shell pass through the left and right sides of the connection slot 325 from the openings 329 of the two side plates of the docking part. The projections 73 of the left and right sides of the metal partition plate 70 elastically rest against the left and right side plates of the metallic inner shell 50, so that the metallic inner shell 50 needs not to be extended backwards to form pins.

The metal housing 60 covers the insulated seat 30 and the metallic inner shell 50. The metal housing 60 is a metal plate sheet drawn to integrally form a four-sided main housing 61 and two positioning sheets 62. The two positioning sheets 62 are connected to the rear end of the four-sided main housing 61 and are much more concave vertically than the four-sided main housing 61. The four-sided main housing 61 is top-bottom symmetrical and left-right symmetrical. The four-sided main housing 61 has no opening hole and gap and shields the docking part 32 to form one docking structure. A shape of the docking structure is such that the docking structure can be dual-positionally bidirectionally positioned with one docking electrical connector. The two positioning sheets 62 are provided with engagement holes 621 engaging with the engagement blocks 38 of the insulated seat 30. The metallic inner shell 50 also has a four-sided housing and is in the form of a second metal shell fitting with and resting against the inside of the metal housing 60. The elastic sheet 57 can ensure the tight contact with the metal housing 60. The two twisted supporting elastic sheets 56, the twisted elastic sheet 54 and the elastic arm 515 rest against each other and are in flat surface contact with the metal housing 60, and form the twisting space with the bottom surface of the slot 326. When the elastic contact sheet 55 is vertically elastically moved, the twisted elastic sheet 54 can be twisted in a direction opposite to the elastically moving direction of the elastic contact sheet 55 through the twisting space. That is, the front end of the twisted elastic sheet 54 is in flat surface contact with the metal housing 60 and the rear end thereof can be twisted vertically. The elastic arm 515 of the left and right sides of the twisted elastic sheet 54 through the twisting space can be reversely elastically moved relatively to the elastic contact sheet 55. The reverse vertical twist of the twisted elastic sheet 54 and the reverse elastic movements of the two elastic arms 515 can make the elastic contact sheet 55 have the excellent resilience.

In addition, the two twisted supporting elastic sheets 56 are in flat surface contact with and rest against the metal housing and are also twisted with the twisted elastic sheet 54, so the resilient support effect is obtained. The middle section of the twisted elastic sheet 54 can be supported and cannot become too soft to be twisted and deformed, so that the middle elastic contact sheet 55 still have the sufficient normal contact force.

In addition, a coating may be further provided to cover the rear section of the metal housing 60.

According to the above-mentioned description, the plug of this embodiment has the following advantages.

1. Each of the left and right side plates of the metallic inner shell 50 is integrally provided with the resilient snap 51, the snap structure can simplified, and the electrical connector can be easily processed and assembled.

2. The metallic inner shell 50 is integrally provided with the upper and lower plates and is provided with the elastic contact sheet 55, the elastic arm of the elastic contact sheet 55 slantingly extends forwards and projects toward the connection slot 325, the elastic contact sheet is provided with a projecting contact 551 and has a front end being a free end and in the form of the guide-in inclined surface. Thus, the upper and lower elastic contact sheets 55 can be integrally provided and the elastic arm of the elastic contact sheet 55 has the longer arm of force.

3. The metallic inner shell 50 is integrally provided with the upper and lower plates, the front sections of the upper and lower plates are provided with the twisted elastic sheet 54 and the elastic arms 515 on the left and right sides, and the twisted elastic sheet 54 is integrally connected to the three elastic contact sheets 55. The twisted elastic sheet 54 and the elastic arms 515 on the two sides can be reversely twisted or elastically moved relatively to the elastic contact sheet 55, and can make the elastic contact sheet 55 have the excellent resilience.

4. The metallic inner shell 50 is integrally provided with the upper and lower plates and the left and right side plates, each of the front ends of the upper and lower plates is provided with three elastic contact sheets, and each of the left and right side plates is integrally provided with the resilient snaps 51 and 55. Thus, the left and right snap structures and the upper and lower grounding structures can be integrally provided, so that the manufacturing and assembling are simplified.

5. The width of the root connected to the elastic contact sheet 55 and the twisted elastic sheet 54 is reduced to form two concave portions 552, so that the twisted elastic sheet 54 has the better twist resilience.

6. The two twisted supporting elastic sheets 56 are in flat surface contact with and rest against the connection plate and the metal housing to prevent the twisted elastic sheet 54 from becoming too soft and tending to be twisted and deformed, and the middle elastic contact sheet 55 still has the sufficient normal contact force 7. The convex surface 327 of the docking part 32 has a thicker structure to form the bouncing space 324 of the distal end of the terminal.

8. Each of the front ends of the left and right sides of one of the upper and lower plates of the metallic inner shell 50 is provided with a horizontal material bridge 58, the material bridge 58 has the front edge in a form of the electroless layer section 581, and the rear edge in the space-providing inclined surface 582. The space-providing inclined surface 582 provides a space for the deployed length of the elastic contact sheet 53. Upon pressing fabrication, the metallic inner shell 50 is connected to a material tape through the material bridge 58 for being pressed and bent.

Figure 8:
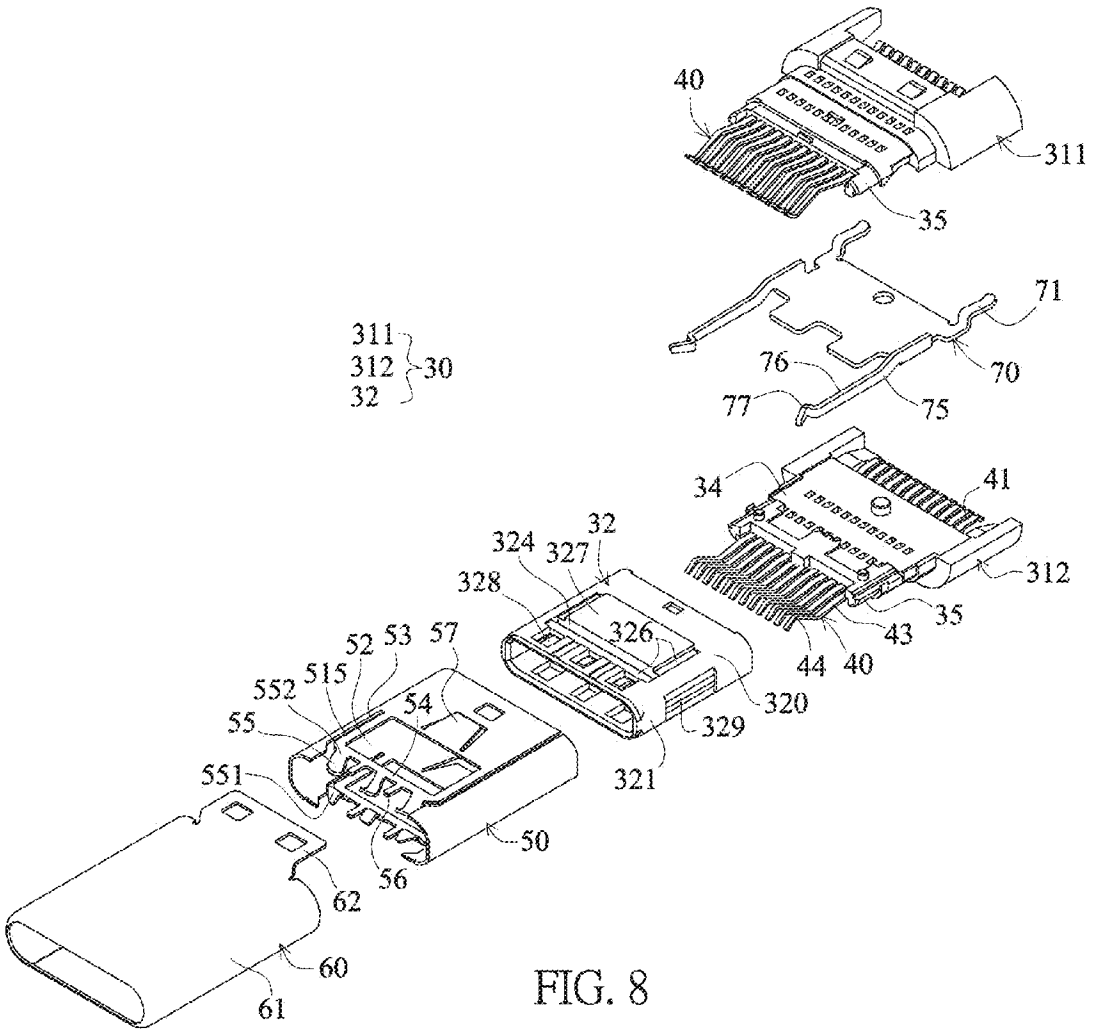
FIG. 8 is a pictorially exploded view according to the second embodiment of the invention.

Please refer to FIG. 8, the second embodiment of the invention is almost the same as the first embodiment except for the difference that the left and right side plates of the metallic inner shell 50 of this embodiment is not provided with the resilient snap 51. However, each of the left and right sides of the metal partition plate 70 has a resilient snap 75, the resilient snap 75 is provided with an elastic arm 76, the elastic arm is provided with a protruding snap 77 near a free end of the elastic arm, and the snaps 77 of the two resilient snaps 75 pass through the left and right sides of the connection slot 325 from the openings 329 of the two side plates of the docking part.

Figures 9, 10:
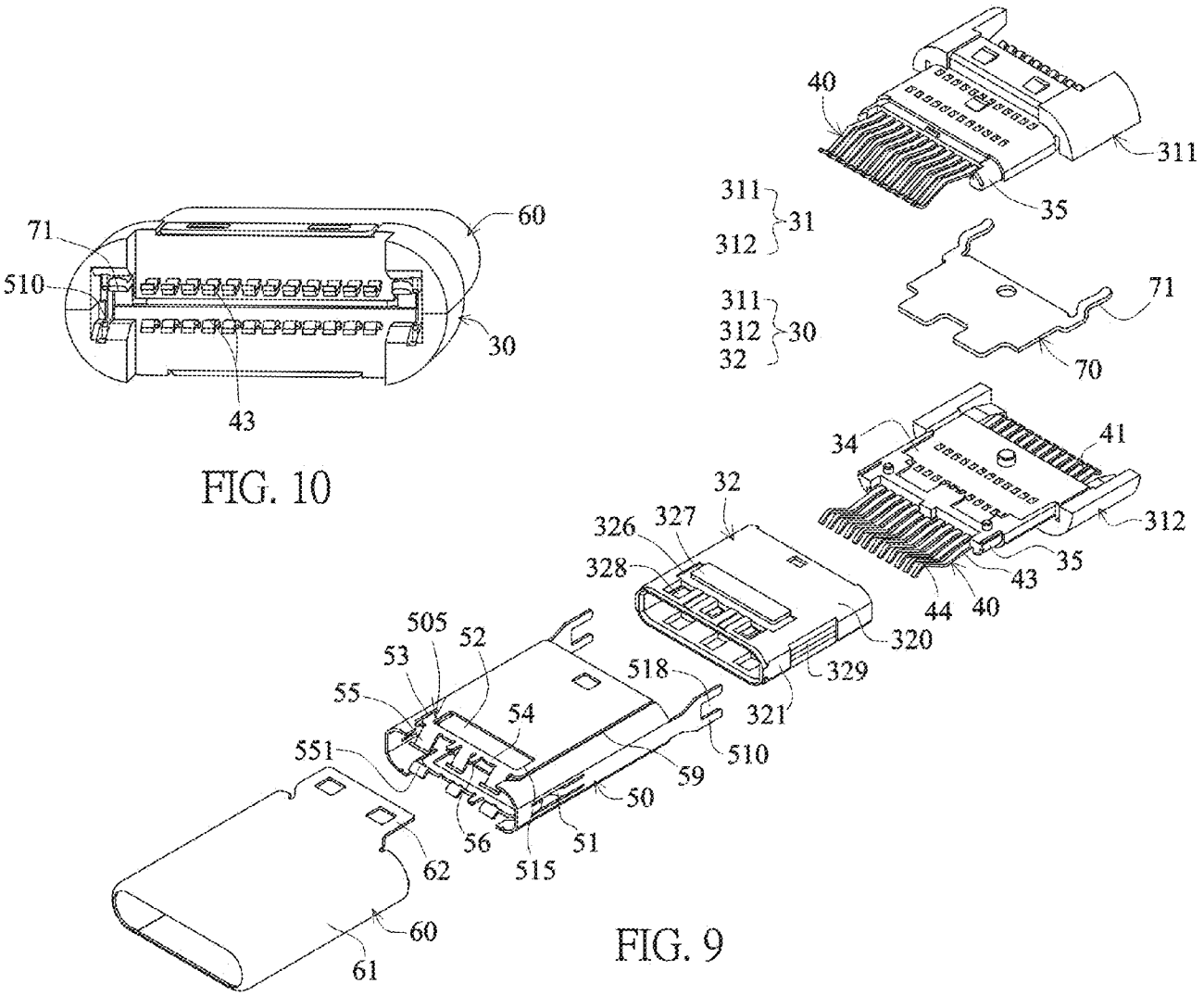
FIG. 9 is a pictorially exploded view according to the third embodiment of the invention.
FIG. 10 is a pictorial rear view according to the third embodiment of the invention.

Please refer to FIGS. 9 and 10, the third embodiment of the invention is almost the same as the first embodiment except for the difference that each of the left and right sides of the rear end of the metallic inner shell 50 of this embodiment is provided with a backward extending pin 510 passing through the base seat 31 of the insulated seat 30 and extending out, the pin 510 is formed with a jaw 518 for clamping a circuit board and bonded to form grounding.

Figure 12:
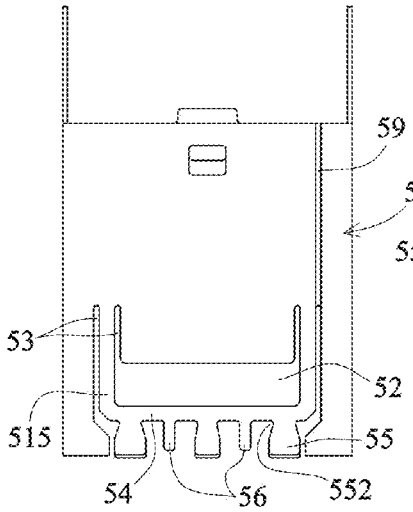
FIG. 12 is a top view showing the metallic inner shell according to the fourth embodiment of the invention.
Figure 11:
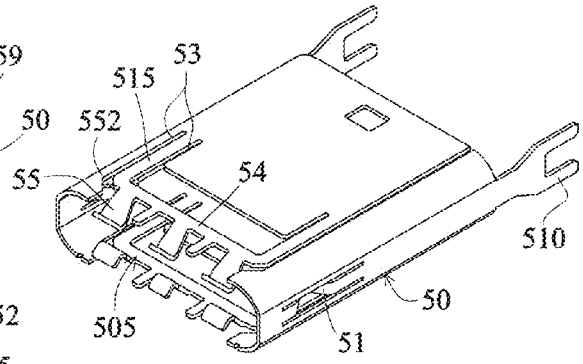
FIG. 11 is a pictorial view showing a metallic inner shell according to the fourth embodiment of the invention.

Please refer to FIGS. 11 and 12, the fourth embodiment of the invention is almost the same as the third embodiment except for the difference that the elastic arms 515 of the twisted elastic sheet 54 of the metallic inner shell 50 of this embodiment on the left and right sides are longer, and the width of the root connected to the elastic contact sheet 55 and the twisted elastic sheet 54 is reduced to form two concave portions 552, so that the twisted elastic sheet 54 has the better twist resilience.

Figure 13:
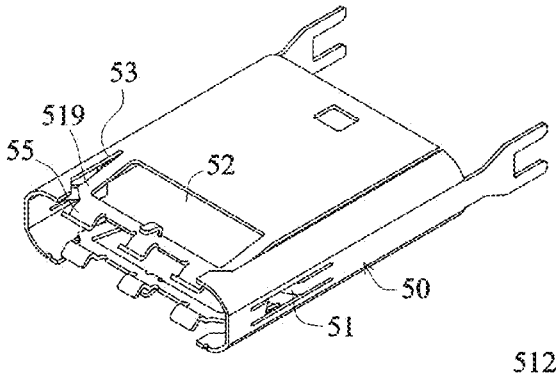
FIG. 13 is a pictorial view showing a metallic inner shell according to the fifth embodiment of the invention.

Please refer to FIG. 13, the fifth embodiment of the invention is almost the same as the third embodiment except for the difference that the front sections of the upper and lower plates of the metallic inner shell 50 of this embodiment are provided with an opening 52 and a gap 53 to form an inverse-U-shaped elastic sheet 519, the elastic sheet 519 is bent downwards, and the front end of the elastic sheet 519 is connected to the three elastic contact sheets 55. When the elastic contact sheet 55 is vertically elastically movable, the elastic sheet 519 is also synchronously vertically elastically movable but not reversely twisted.

Figure 14:
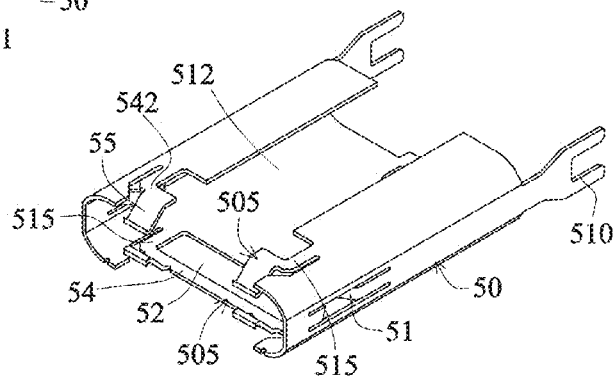
FIG. 14 is a pictorial view showing a metallic inner shell according to the sixth embodiment of the invention.

Please refer to FIG. 14, the sixth embodiment of the invention is a USB TYPE-C 2.0 electrical connection plug, and is almost the same as the third embodiment except for the difference that each of the upper and lower plates of the metallic inner shell 50 in this embodiment is connected and provided with two elastic contact sheets 55. A middle section of the top plate is formed with an opening 512 extending in a front-to-rear direction and only has two side portions, the twisted elastic sheet of the top plate is broken into two shorter twisted elastic sheets 542, each of the two side portions is connected to the twisted contact piece 505, the twisted contact piece 505 is connected to a shorter twisted elastic sheet 542, each of the rear ends of the two shorter twisted elastic sheets 542 is connected to the elastic arm 515 extending in a front-to-rear direction, and each of the front ends is connected to an elastic contact sheet 55. The twisted elastic sheet 54 of the twisted contact piece 505 of the bottom plate is integrally connected to the two elastic contact sheets 55, each of the twisted elastic sheets 54 on the left and right sides of the bottom plate is connected to an elastic arm 515 extending in a front-to-rear direction.

Figures 15, 15A, 16, 17, 18, 19:
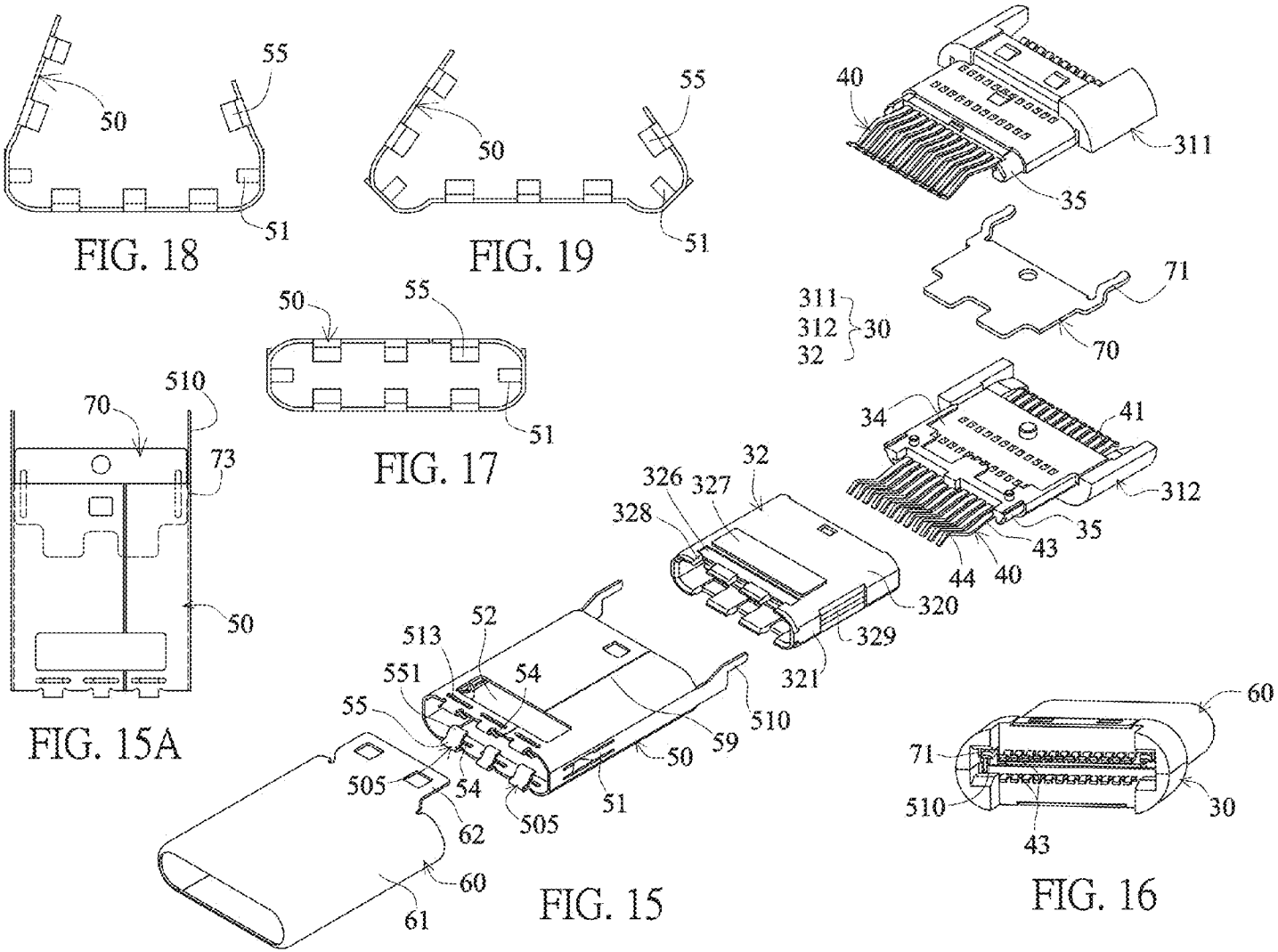
FIG. 15 is a pictorially exploded view according to the seventh embodiment of the invention.
FIG. 15A is a top view showing another implementation according to the seventh embodiment of the invention.
FIG. 16 is a pictorial rear view according to the seventh embodiment of the invention.
FIG. 17 is a front view showing a metallic inner shell according to the seventh embodiment of the invention.
FIG. 18 is a front view showing the opened state of the metallic inner shell according to the seventh embodiment of the invention.
FIG. 19 is a front view showing the opened state of the metallic inner shell according to the seventh embodiment of the invention.

Please refer to FIGS. 15 to 17, the seventh embodiment of the invention is almost the same as the third embodiment except for the difference that the seam 59 of the metallic inner shell 50 in this embodiment is disposed at the middle of the top plate. Each of the plate sheets extending in a left-to-right direction and being disposed in front of the openings 52 of the upper and lower plates of the metallic inner shell 50 is provided with three opening holes 513 extending in the left-to-right direction. The front end of each opening hole 513 is in the form of a twisted elastic sheet 54 extending in a left-to-right direction. Each twisted elastic sheet 54 is integrally connected to an elastic contact sheet 55 to form a twisted contact piece 505. The left and right sides of the twisted elastic sheet 54 are not provided with the elastic arms, and the elastic contact sheet 55 is bent inwardly and reversely from the front ends of the upper and lower plates to form an elastic arm extending in the inserting direction and a projecting contact 551. The openings 328 of the upper and lower plates of the docking part 32 are disposed on the frontmost end. In addition, the metal partition plate 70 is not provided with a projection elastically resting against the metallic inner shell 50. However, each of the left and right sides is provided with a pin 71 extending out of the base seat.

Please refer to FIG. 15A, the metal partition plate 70 in this embodiment is also not provided with the pin. However, each of the left and right sides is provided with a resilient projection 73 resting against the metallic inner shell 50.

Please refer to FIGS. 17 to 19, when the metallic inner shell 50 is fitted and assembled with the docking part 32, the metallic inner shell 50 is fitted by way of bending, as shown in FIG. 17, or is in the form of an open shape, and bounced back to form the shape after fitting, as shown in FIGS. 18 and 19.

Figure 20:
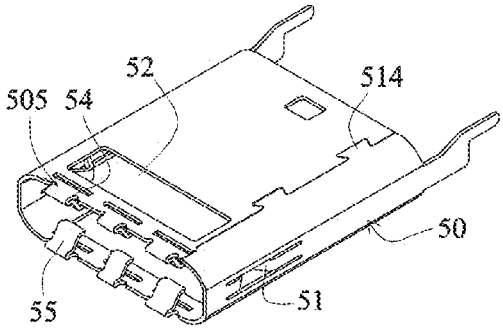
FIG. 20 is a pictorial view showing a metallic inner shell according to the eighth embodiment of the invention.

Please refer to FIG. 20, the eighth embodiment of the invention is almost the same as the seventh embodiment except for the difference that the metallic inner shell 50 of this embodiment is connected and locked on the left or right side of the top plate using the dovetail slot locking structure 514.

Figure 21:
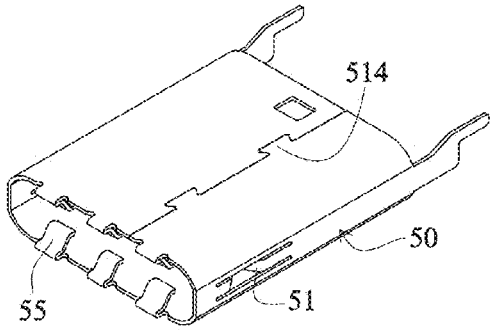
FIG. 21 is a pictorial view showing a metallic inner shell according to the ninth embodiment of the invention.

Please refer to FIG. 21, the ninth embodiment of the invention is almost the same as the seventh embodiment except for the difference that the upper and lower plates of the metallic inner shell 50 in this embodiment are not provided with the opening and the twisted elastic sheet.

Figure 22:
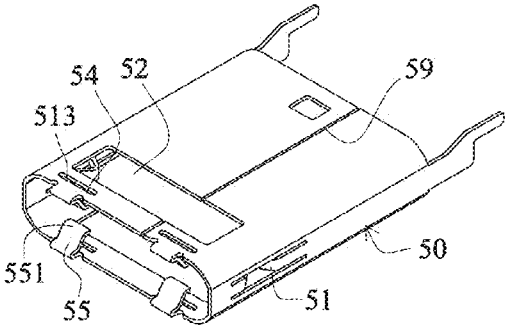
FIG. 22 is a pictorial view showing a metallic inner shell according to the tenth embodiment of the invention.

Please refer to FIG. 22, the tenth embodiment of the invention is a USB TYPE-C 2.0 electrical connection plug, and is almost the same as the seventh embodiment except for the difference that each of the upper and lower plates of the metallic inner shell 50 in this embodiment is connected and provided with two elastic contact sheets 55.

Figure 23:
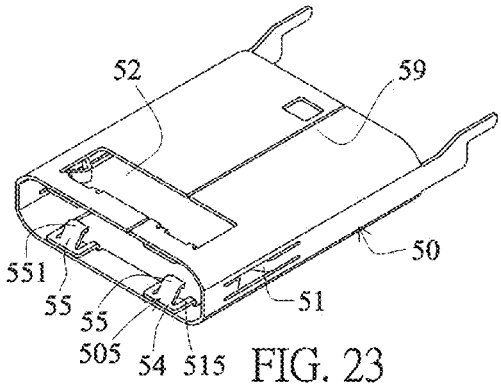
FIG. 23 is a pictorial view showing a metallic inner shell according to the eleventh embodiment of the invention.

Please refer to FIG. 23, the eleventh embodiment of the invention is almost the same as the tenth embodiment except for the difference that the twisted contact pieces 505 of the upper and lower plates of the metallic inner shell 50 in this embodiment are bent frontwards and reversely from the opening 52 of the plate sheet, which is to be originally pressed, and are then stacked and pressed. The twisted contact piece 505 is provided with a twisted elastic sheet 54 extending in a left-to-right direction and resting against the upper and lower plates of the metallic inner shell 50. The twisted elastic sheet 54 is integrally connected to a forward elastic contact sheet 55, and each of the left and right sides is connected to an elastic arm 515 extending in a front-to-rear direction. The elastic contact sheet 55 is provided with the projecting contact 551.

Figure 24:
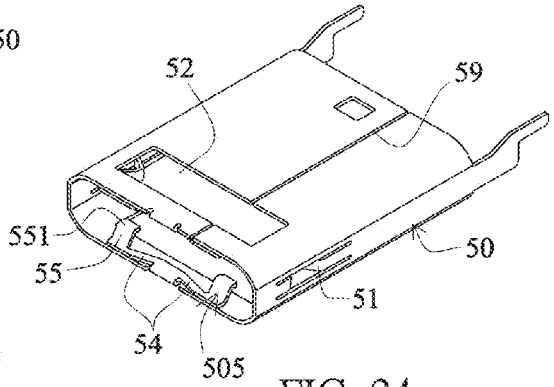
FIG. 24 is a pictorial view showing a metallic inner shell according to the twelfth embodiment of the invention.

Please refer to FIG. 24, the twelfth embodiment of the invention is almost the same as the tenth embodiment except for the difference that each of the upper and lower plates of the metallic inner shell 50 in this embodiment is provided with two twisted contact pieces 505. The two twisted contact pieces 505 respectively extend leftward and rightward to form twisted elastic sheets 54, and the twisted elastic sheet 54 is connected to an elastic contact sheet 55.

Figure 26:
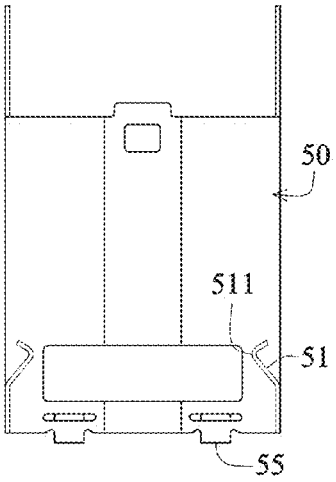
FIG. 26 is a top view showing the metallic inner shell according to the thirteenth embodiment of the invention.
Figure 25:
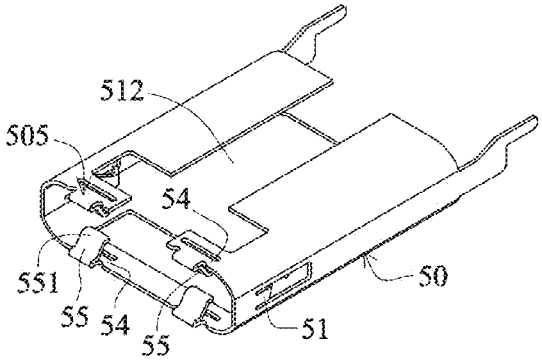
FIG. 25 is a pictorial view showing a metallic inner shell according to the thirteenth embodiment of the invention.

Please refer to FIGS. 25 and 26, the thirteenth embodiment of the invention is almost the same as the tenth embodiment except for the difference that the rear ends of the resilient snaps 51 of the left and right side plates of the metallic inner shell 50 in this embodiment are open, a middle section of the top plate is formed with an opening 512 extending in a front-to-rear direction and only has two side portions, and each of the two side portions is connected to the a twisted contact piece 505.

Figure 27:
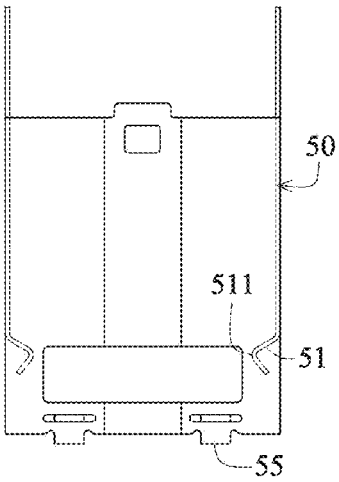
FIG. 27 is a top view showing a metallic inner shell according to the 14th embodiment of the invention.

Please refer to FIG. 27, the 14th embodiment of the invention is almost the same as the thirteenth embodiment except for the difference that the front ends of the resilient snaps 51 of the left and right side plates of the metallic inner shell 50 in this embodiment are open.

Figure 28:
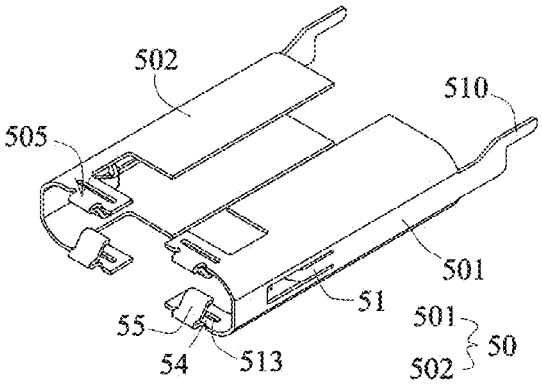
FIG. 28 is a pictorial view showing a metallic inner shell according to the 15th embodiment of the invention.

Please refer to FIG. 28, the 15th embodiment of the invention is almost the same as the 14th embodiment except for the difference that the middle sections of the upper and lower plates of the metallic inner shell 50 in this embodiment are formed with openings extending in the front-to-rear direction and broken into separated left and right housings 502 and 501. The left housing 502 forms the left side plate and the left side plate surfaces of the upper and lower plates, and the right housing 501 forms the right side plate and the right side plate surfaces of the upper and lower plates. The left side plate of the left housing 502 is similarly provided with the resilient snap 51, and each of the upper and lower plates is provided with the elastic contact sheet 55. The right side plate of the right housing 501 is similarly provided with the resilient snap 51 and each of the upper and lower plates is provided with the elastic contact sheet 55.

Figure 29:
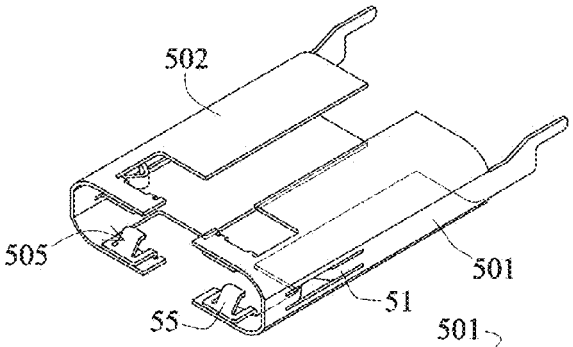
FIG. 29 is a pictorial view showing a metallic inner shell according to the 16th embodiment of the invention.

Please refer to FIG. 29, the 16th embodiment of the invention is almost the same as the eleventh embodiment and the 15th embodiment.

Figures 30, 30A:
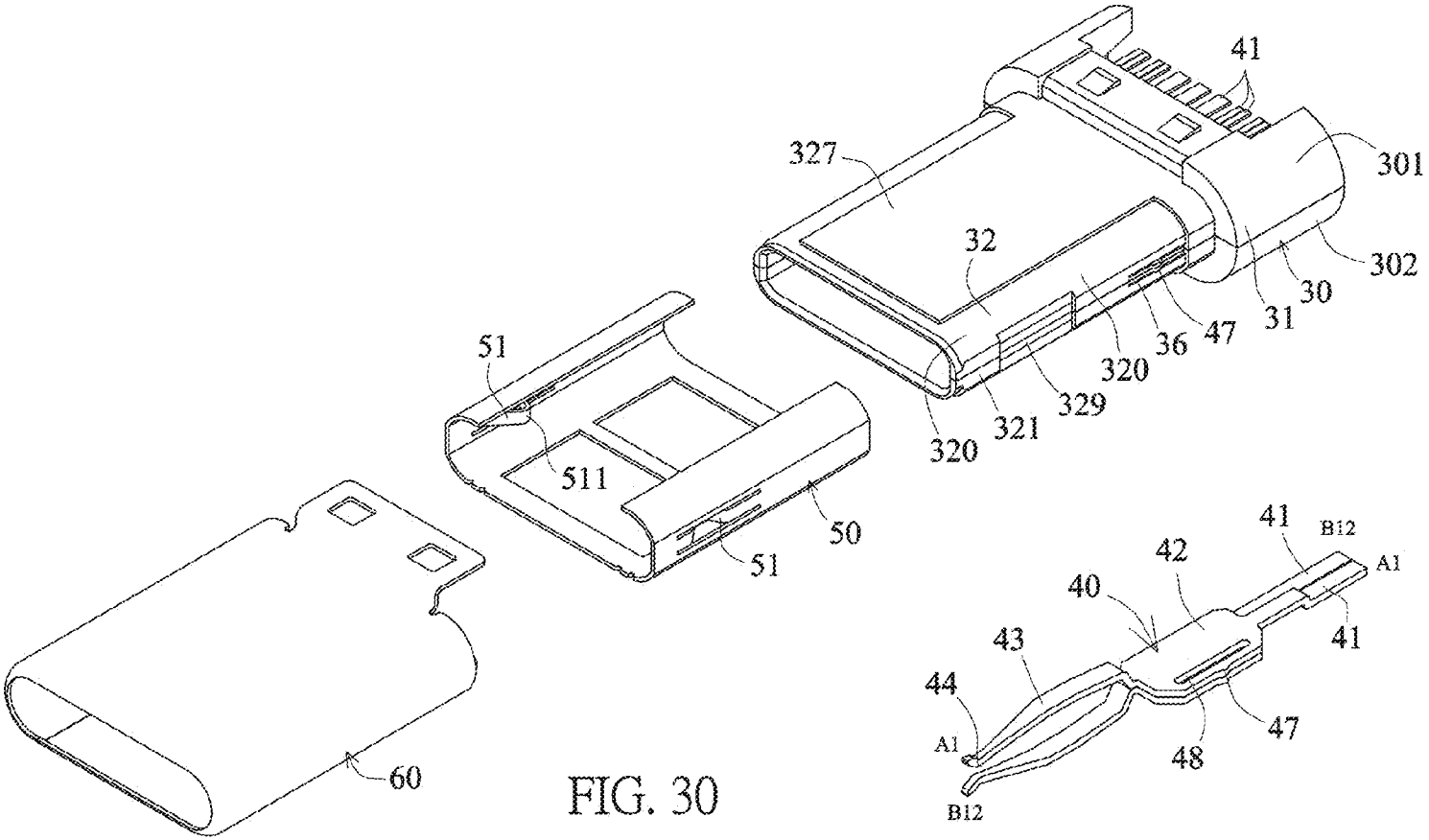
FIG. 30 is a pictorially exploded view according to the 17th embodiment of the invention.
FIG. 30A is a pictorial view showing one pair of ground terminals resting against each other according to the 17th embodiment of the invention.
Figure 31:
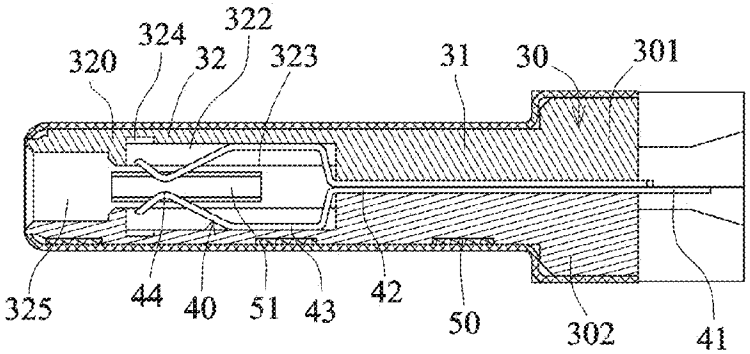
FIG. 31 is a cross-sectional side view according to the 17th embodiment of the invention.
Figure 32:
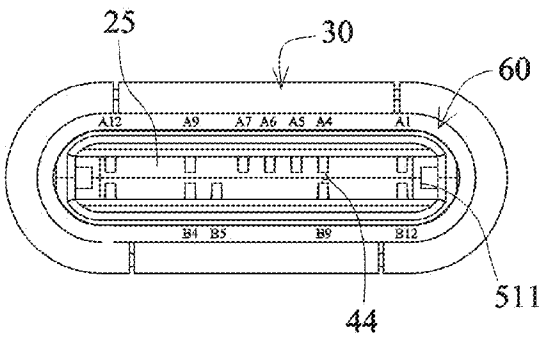
FIG. 32 is a front view according to the 17th embodiment of the invention.

Please refer to FIGS. 30 to 32, the 17th embodiment of the invention is a USB TYPE-C 2.0 electrical connection plug, and is almost the same as the first embodiment except for the difference that the insulated seat 30 in this embodiment is provided with directly stacked upper and lower seat bases 301 and 302, the upper seat base 301 is integrally provided with the upper base seat and the upper docking part, the lower seat base 302 is integrally provided with the lower base seat and the lower docking part, the upper docking part has an inverse-U shaped frame body, the lower docking part has a U-shaped frame body, the upper and lower docking parts are stacked to form a rectangularly-shaped fitting frame body, the two terminal sets are respectively assembled with and fixed to the upper and lower seat bases 301 and 302, the contacts of the two terminal sets having connection points with the same circuit serial numbers are arranged reversely, and two terminal sets are discontinuous arranged due to the lack of pin or pins, wherein a terminal set of the upper seat base 301 is one row of seven terminals 40, and the connection points have the circuit serial numbers A1, A4, A5, A6, A7, A9, A12 from right to left, wherein two side terminals A1, A12 are ground terminals, and A4, A9 are power terminals. A terminal set of the lower seat base 301 is one row of 5 terminals, and the connection points have the circuit serial numbers B12, B9, B4, B5, B1 from right to left, wherein two side terminals B1, B12 are ground terminals, and B4, B9 are power terminals. So, four pairs of vertically aligned terminals A1/B12, A4/B9, A9/B4, A12/B1 have the same circuit to form the electrical connection. As shown in FIG. 30A, the fixing portions 42 of both of them are stacked and the pins 41 have the same height and are connected in parallel. In addition, the fixing portions 42 of two side ground terminals A1/B12, A12/B1 are provided with outwardly projecting elastic projections 47 elastically resting against the metallic inner shell 50, so that the metallic inner shell 50 needs not to be provided with the pin. The metallic inner shell 50 rests against the metal housing 60, so that the two side ground terminals A1/B12, A12/B1 are electrically connected to the metal housing 60 and grounded. The fixing portion 42 provided with an opening hole 48 makes the elastic projection 47 be elastically movable.

The middle section of the top plate of the metallic inner shell 50 is broken. The left and right side plates are connected together through the bottom plate. The upper and lower plates are not provided with the elastic contact sheet. The left and right side plates are similar to the first embodiment and are formed by pressing the plate surface and are integrally bent inwardly to form the resilient snaps 51.

In addition, each of the middles of the two connection plates 320 of the docking part 32 is provided with the convex surface 327, the convex surface 327 has the thicker structure to form the bouncing space 324 of the distal end of the terminal, and the bouncing space 324 has the bottom surface and is in the form of the slot.

This embodiment provides the simple USB TYPE-C 2.0 electrical connection plug, which is not provided with the elastic contact sheet and the metal partition plate, but is only provided with the snapping elastic sheet.

Figure 33:
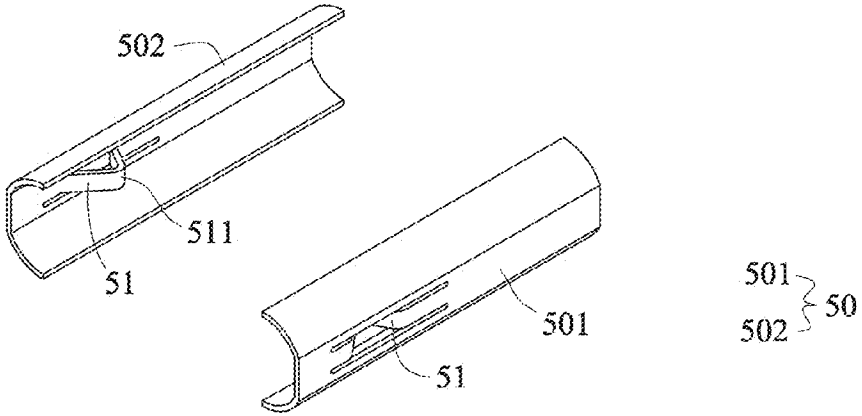
FIG. 33 is a pictorial view showing a metallic inner shell according to the 18th embodiment of the invention.

Please refer to FIG. 33, the 18th embodiment of the invention is almost the same as the 17th embodiment except for the difference that the metallic inner shell 50 of this embodiment is further simplified into separated left and right housings 501 and 502. The left housing forms the left side plate, the right housing forms the right side plate, and each of the left and right side plates is pressed and integrally bent inwardly to form a resilient snap 51.

Figure 35:
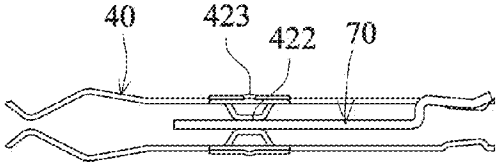
FIG. 35 is a partial side combination view according to the 19th embodiment of the invention.
Figure 36:
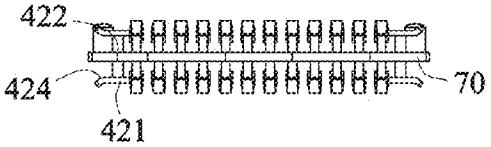
FIG. 36 is a partially front combination view according to the 19th embodiment of the invention.
Figure 34:
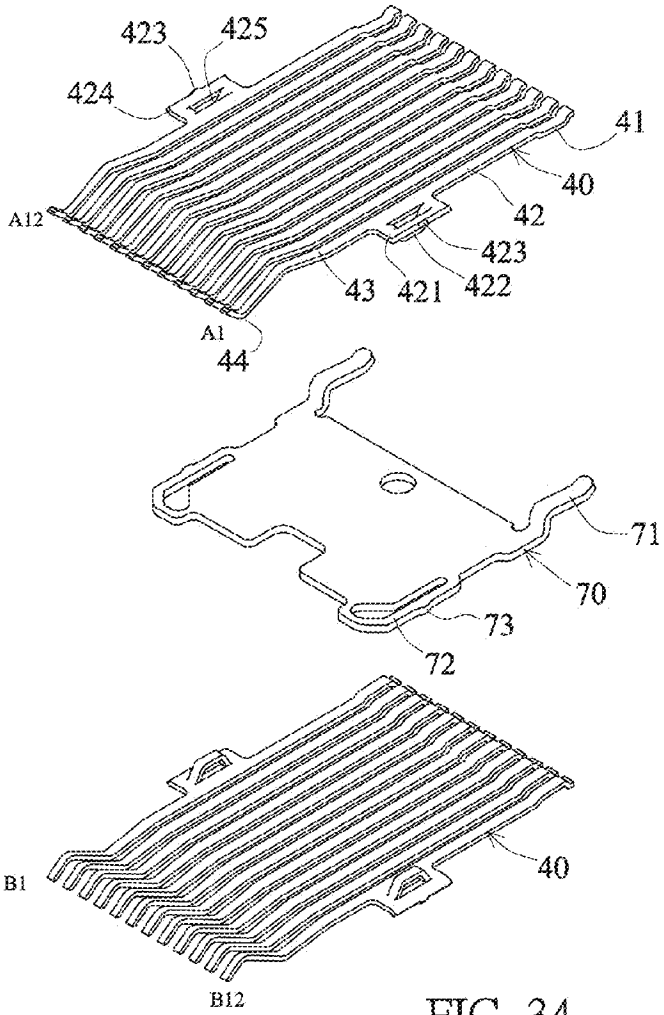
FIG. 34 is a partially pictorially exploded view according to the 19th embodiment of the invention.

Please refer to FIGS. 34 to 36, the 19th embodiment of the invention is a USB TYPE-C 3.0 electrical connection plug, and is almost the same as the first embodiment except for the difference that the two side terminals 40 (A1, A12, B1, B12) of two terminal sets in this embodiment are ground terminals. The fixing portion 42 of each ground terminal is provided with a wide plate 421, which projects outwards and has the wider plate surface. The wide plate 421 is prodded to form a projection 422, which extends in the top-bottom direction and rests against the metal partition plate 70. The outside of the wide plate 421 is provided with a lateral projection 423 resting against the metallic inner shell 50. The opening 425 on the wide plate 421 makes the projection 423 form the lateral elastic movement resilience. The left and right sides of the metal partition plate 70 are similarly provided with resilient projections 73 resting against the metallic inner shell 50.

In addition, the outer edge of the wide plate 421 is provided with a curved arc 424 opposite to the projection 422, so that the projection 423 rests against the metallic inner shell 50 on a larger plane.

Figure 37:
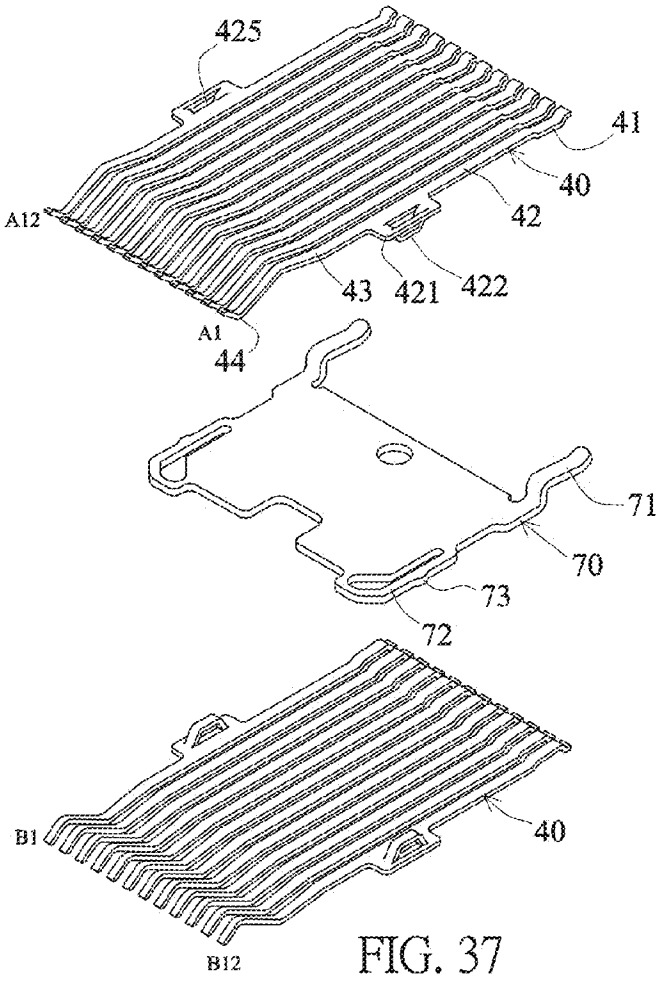
FIG. 37 is a partially pictorially exploded view according to the 20th embodiment of the invention.

Please refer to FIG. 37, the 20th embodiment of the invention is almost the same as the 19th embodiment except for the difference that the outsides of the wide plates 421 of the fixing portions 42 of the two side ground terminals 40 (A1, A12, B1, B12) of the two terminal sets in this embodiment are not provided with the lateral projection 423 resting against the metallic inner shell 50.

Figure 38:
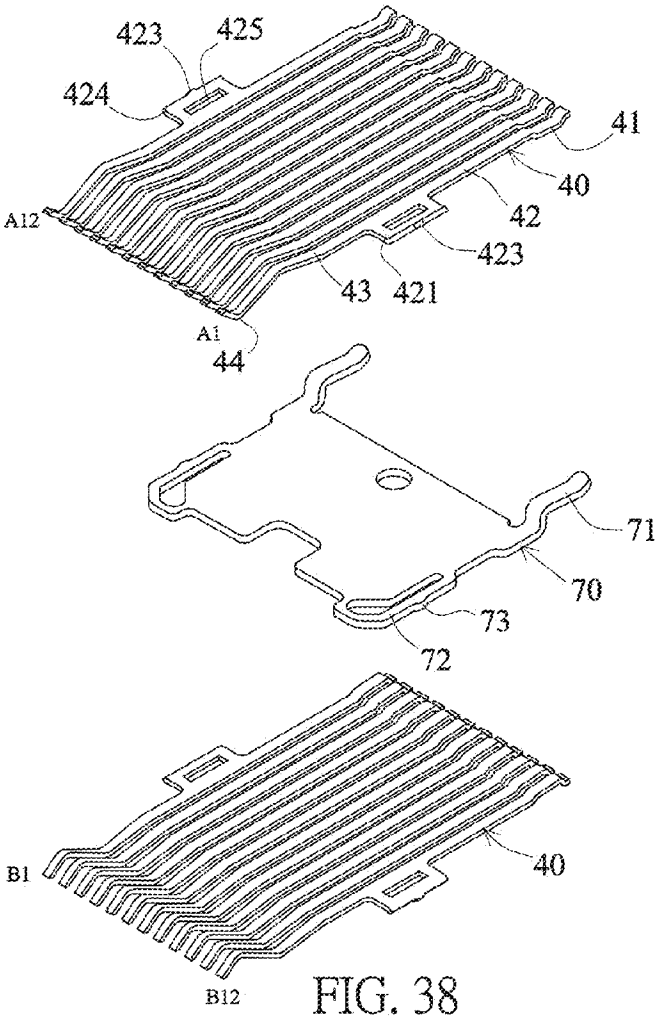
FIG. 38 is a partially pictorially exploded view according to the 21st embodiment of the invention.

Please refer to FIG. 38, the 21st embodiment of the invention is almost the same as the 19th embodiment except for the difference that the wide plates 421 of the fixing portions 42 of the two side ground terminals 40 (A1, A12, B1, B12) of the two terminal sets in this embodiment are not provided with the projection 422 extending in the top-bottom direction and resting against the metal partition plate 70.

Figure 39:
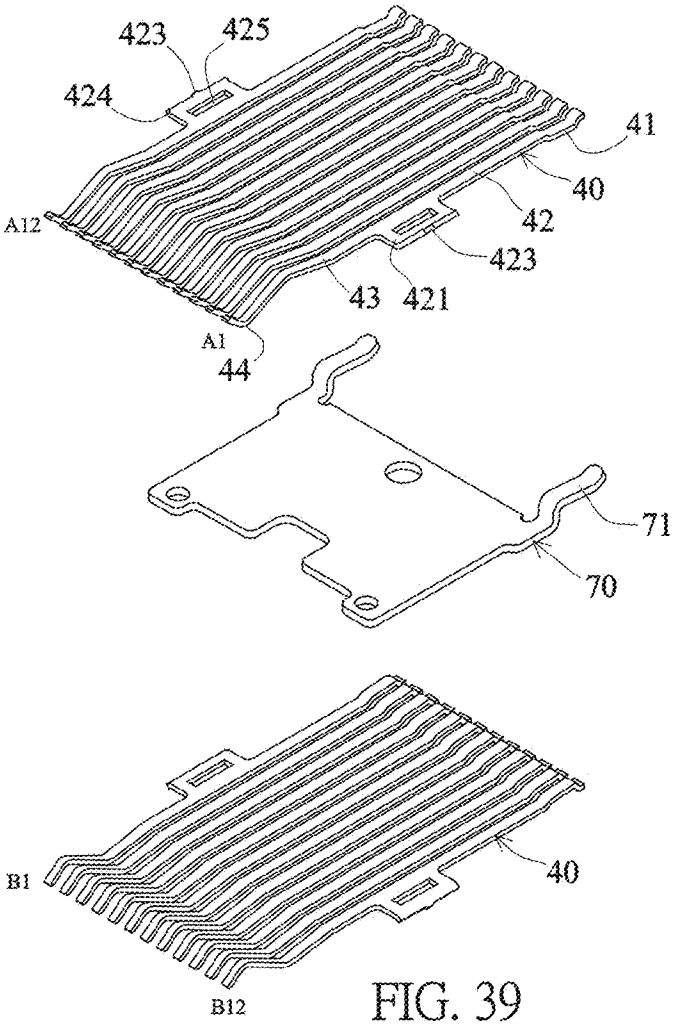
FIG. 39 is a partially pictorially exploded view according to the 22nd embodiment of the invention.

Please refer to FIG. 39, the 22nd embodiment of the invention is almost the same as the 19th embodiment except for the difference that the wide plates 421 of the fixing portions 42 of the two side ground terminals 40 (A1, A12, B1, B12) of the two terminal sets in this embodiment are not provided with the projection 422 extending in the top-bottom direction and resting against the metal partition plate 70, and only the outside is provided with the lateral projection 423 resting against the metallic inner shell 50. In addition, the left and right sides of the metal partition plate 70 are not provided with projections 73 resting against the metallic inner shell 50.

Figure 42:
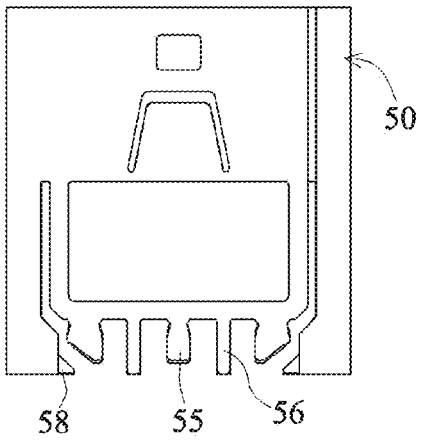
FIG. 42 is a top view showing the metallic inner shell according to the 23rd embodiment of the invention.
Figure 41:
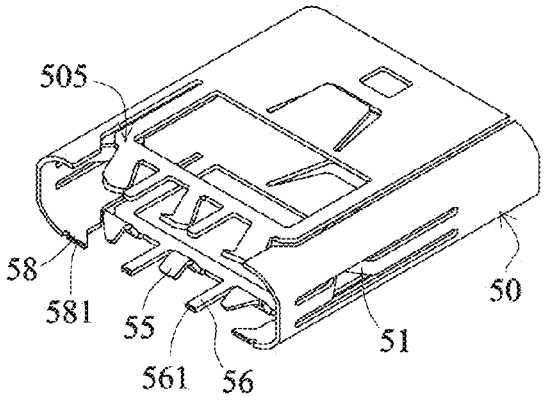
FIG. 41 is a pictorial view showing the metallic inner shell according to the 23rd embodiment of the invention.
Figure 40:
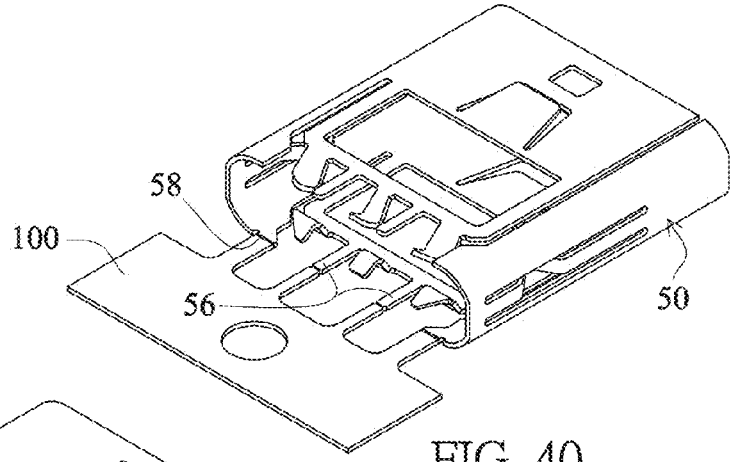
FIG. 40 is a pictorial view showing a metallic inner shell connected to a material tape according to the 23rd embodiment of the invention.

Please refer to FIGS. 40 to 42, the 23rd embodiment of the invention is almost the same as the first embodiment except for the difference that the two material bridges 58 and the two twisted supporting elastic sheets 56 of the metallic inner shell 50 in this embodiment are connected to a material tape 100 upon pressing fabrication, as shown in FIG. 40. When the material tape 100 is broken, the front edge of the material bridge 58 is in a form of an electroless layer section 581, the front end of the twisted supporting elastic sheet 56 is in a form of an electroless layer section 561 which is flush with the electroless layer section 581 and extends out of the elastic contact sheet 55.

Figure 43:
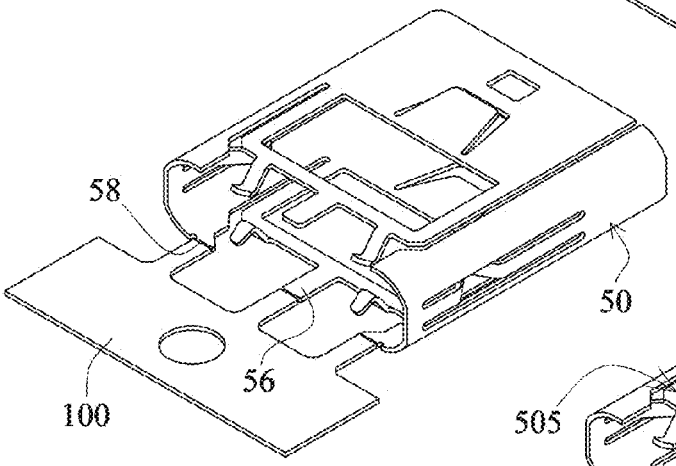
FIG. 43 is a pictorial view showing a metallic inner shell connected to a material tape according to the 24th embodiment of the invention.
Figure 44:
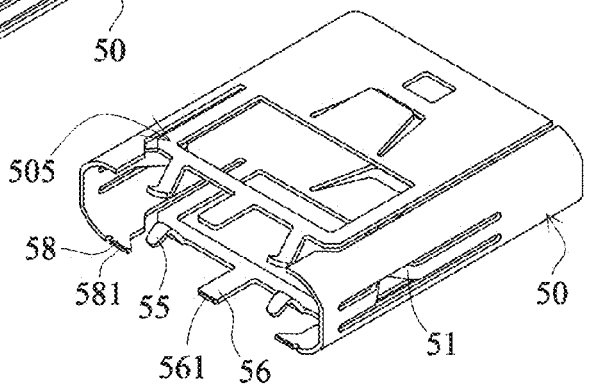
FIG. 44 is a pictorial view showing the metallic inner shell according to the 24th embodiment of the invention.

Please refer to FIGS. 43 and 44, the 24th embodiment of the invention is almost the same as the 23rd embodiment except for the difference that this embodiment is a USB TYPE-C 2.0 electrical connection plug, and each of the upper and lower plates of the metallic inner shell 50 is provided with two elastic contact sheets 55 and a twisted supporting elastic sheet 56.

Figure 45:
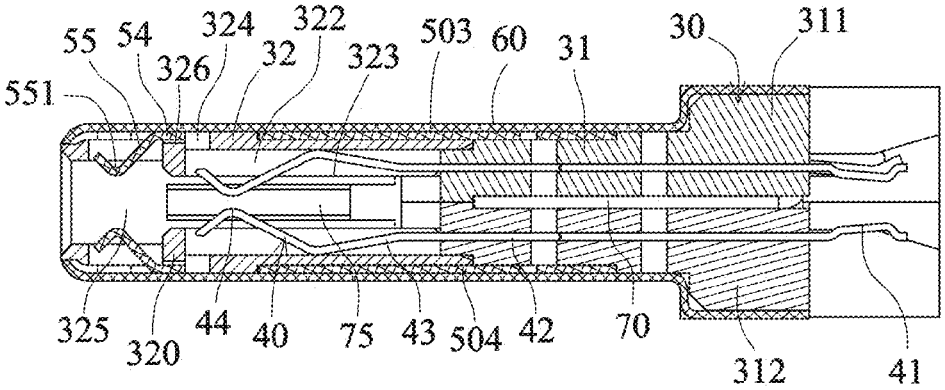
FIG. 45 is a cross-sectional side view according to the 25th embodiment of the invention.
Figure 47:
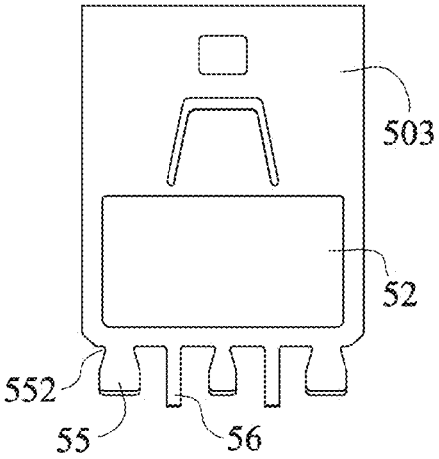
FIG. 47 is a top view showing a top plate according to the 25th embodiment of the invention.
Figure 46:
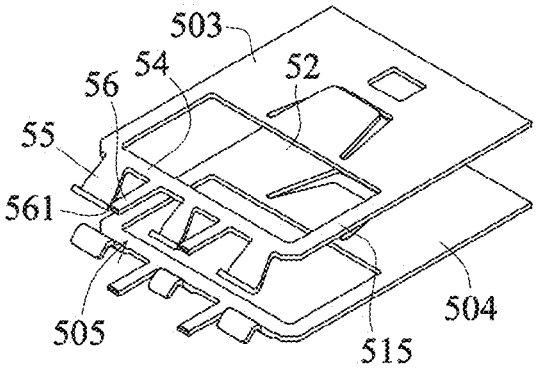
FIG. 46 is a pictorial view showing upper and lower plates according to the 25th embodiment of the invention.

Please refer to FIGS. 45 to 47, the 25th embodiment of the invention is almost the same as the second embodiment except for the difference that between the metal housing 60 and the docking part 32 of this embodiment is further provided with metallic upper and lower plates 503 and 504. The upper and lower plates 503 and 504 are separated from each other in a vertical direction, are respectively connected to and positioned outside the two connection plates 320 of the docking part 32 and rest against the metal housing 60. The structures of the upper and lower plates 503 and 504 are almost the same as the upper and lower plates of the metallic inner shell 50 of the second embodiment, and each of the upper and lower plates is similarly provided with a twisted contact piece 505. The twisted contact piece 505 is similarly provided with a twisted elastic sheet 54. The twisted elastic sheet 54 is in the form of a left-right extending sheet and integrally connected and provided with three elastic contact sheets 55 and two twisted supporting elastic sheets 56. Each of the left and right sides of the twisted elastic sheet is connected to an elastic arm 515 extending in a front-to-rear direction. The two connection plates 320 of the docking part 32 are provided with slots for providing spaces for twisting of the twisted elastic sheets 326. The twisted elastic sheet 54, the two twisted supporting elastic sheets 56 and the two elastic arms 515 rest against the metal housing 60 and correspond to the slot 326 to have the twisting space. When the elastic contact sheet 55 is vertically elastically movable, the twisted elastic sheet, the two twisted supporting elastic sheets 56 and the two elastic arms 515 can be twisted in a direction opposite to the elastically moving direction of the elastic contact sheet 55 through the twisting space.

The two twisted supporting elastic sheets 56 are also in flat surface contact with and rest against the metal housing 60 and can be twisted with the twisted elastic sheet 54, and thus have the resilient support effect, so that the middle section of the twisted elastic sheet 54 is supported and is free from becoming too soft to be twisted and deformed, and the middle elastic contact sheet 55 still has the sufficient normal contact force. In addition, the upper and lower plates 503 and 504 are connected to a material tape by the two twisted supporting elastic sheets 56. So, after the material tape is broken, the front ends of the two twisted supporting elastic sheets 56 are in a form of an electroless layer section 561.

Figure 48:
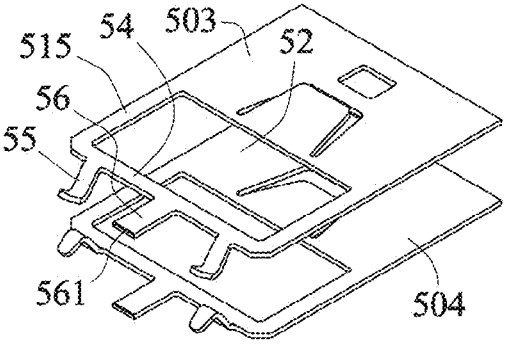
FIG. 48 is a pictorial view showing upper and lower plates according to the 26th embodiment of the invention.

Please refer to FIG. 48, the 26th embodiment of the invention is substantially the same as the 25th embodiment except for the difference that this embodiment is a USB TYPE-C 2.0 electrical connection plug, and each of the upper and lower plates 503 and 504 is provided with two elastic contact sheets 55 and a twisted supporting elastic sheet 56.

Figure 50:
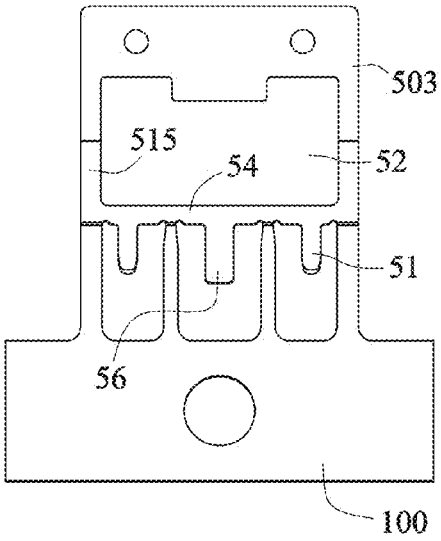
FIG. 50 is a top view showing a top plate connected to a material tape according to the 27th embodiment of the invention.
Figure 49:
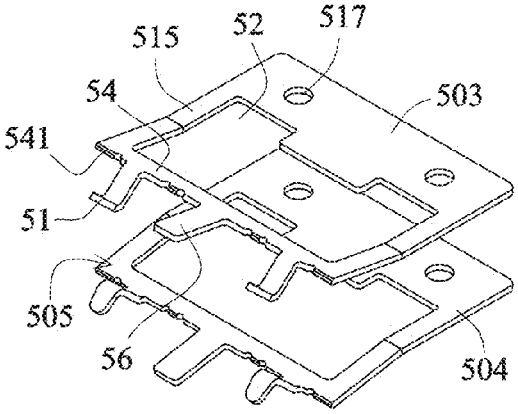
FIG. 49 is a pictorial view showing upper and lower plates according to the 27th embodiment of the invention.

Please refer to FIGS. 49 and 50, the 27th embodiment of the invention is substantially the same as the 26th embodiment except for the difference that four portions of the front ends of the twisted elastic sheets 54 of the upper and lower plates 503 and 504 in this embodiment are connected to a material tape 100. So, after the material tape is broken, the front ends of the twisted elastic sheets 54 form four electroless layer sections 541. In addition, the elastic arms 515 of two sides of the twisted elastic sheet 54 are bent by an angle to be in flat surface contact with the metal housing 60 in an overpressure manner.

Figure 51:
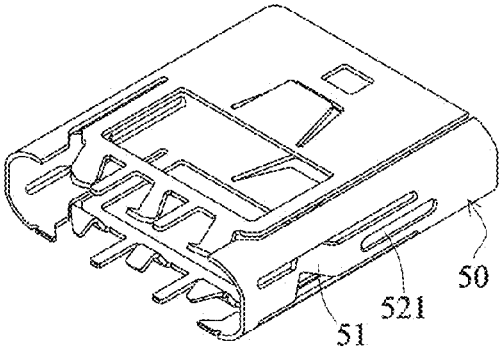
FIG. 51 is a pictorial view showing a metallic inner shell according to the 28th embodiment of the invention.

Please refer to FIG. 51, the 28th embodiment of the invention is almost the same as the 23rd embodiment except for the difference that the plate surfaces of the two resilient snaps 51 of the metallic inner shell 50 in this embodiment are wider and are provided with reinforcing ribs 521 for allowing the resilient snap 51 to have a stronger snap strength.

Figure 52:
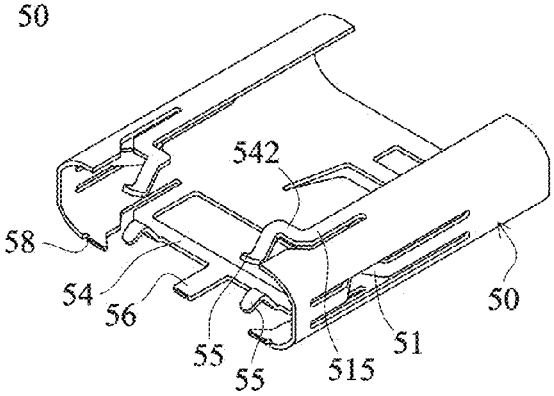
FIG. 52 is a pictorial view showing a metallic inner shell according to the 29th embodiment of the invention.

Please refer to FIG. 52, the 29th embodiment of the invention is substantially the same as the 24th embodiment. However, the top plate structure of the metallic inner shell 50 is the same as that of the sixth embodiment.

Figure 53:
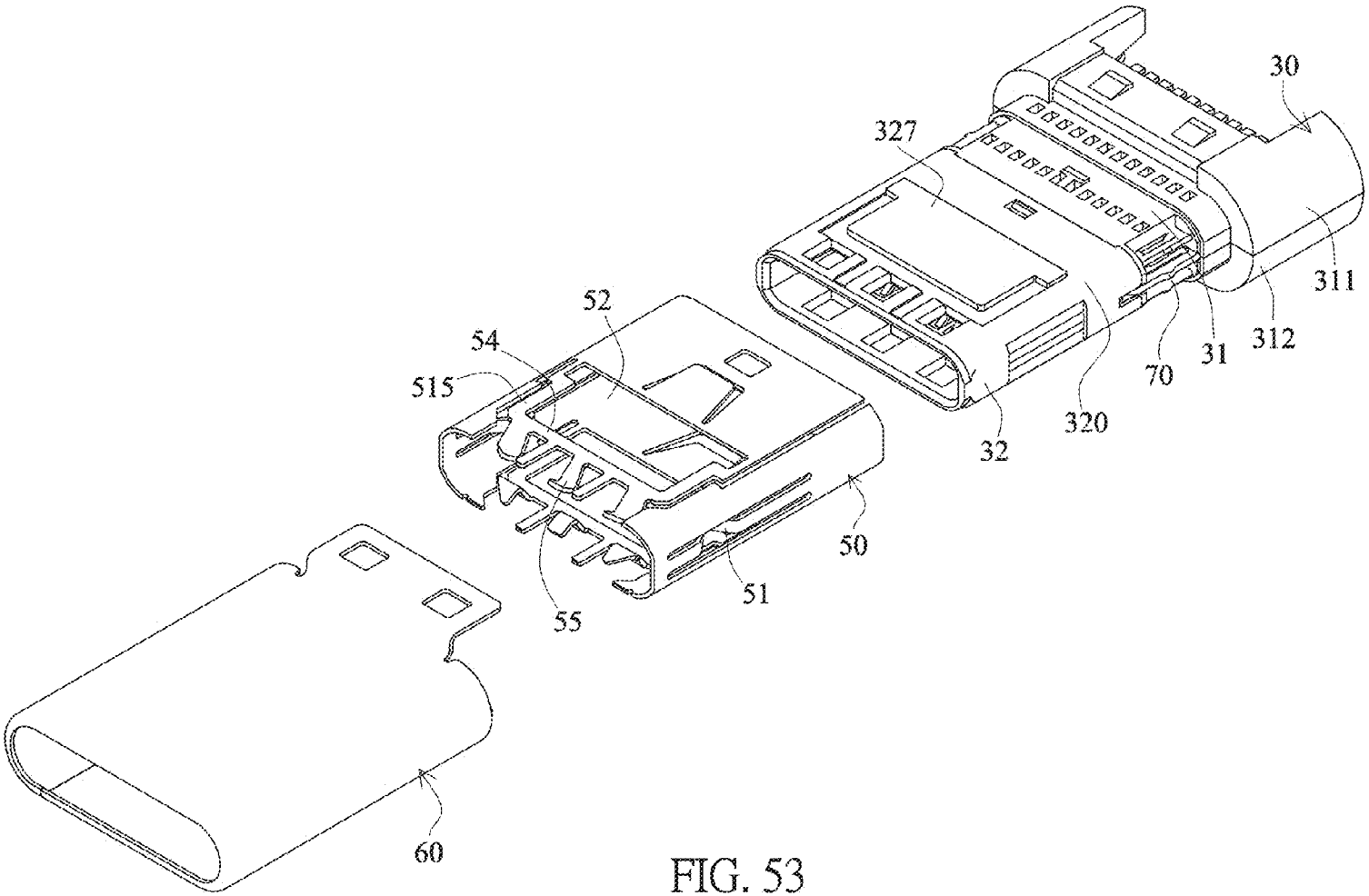
FIG. 53 is a pictorially exploded view according to the 30th embodiment of the invention.

Please refer to FIG. 53, the 30th embodiment of the invention is almost the same as the 23rd embodiment except for the difference that the opening 52 of the metallic inner shell 50 and the convex surface 327 the docking part 32 in this embodiment have the inverse-T-shape.

Figure 54:
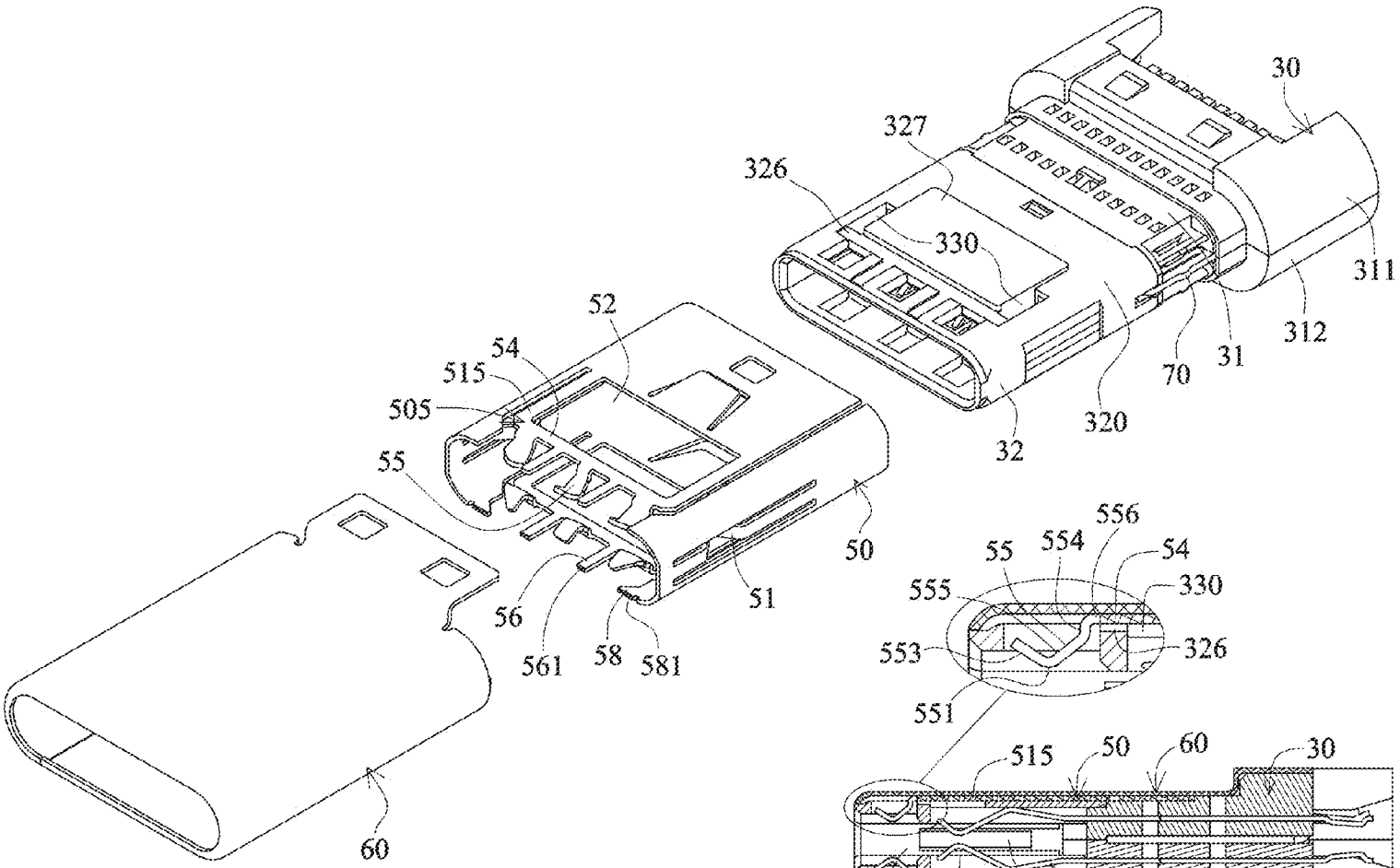
FIG. 54 is a pictorially exploded view according to the 31st embodiment of the invention.
Figure 55:
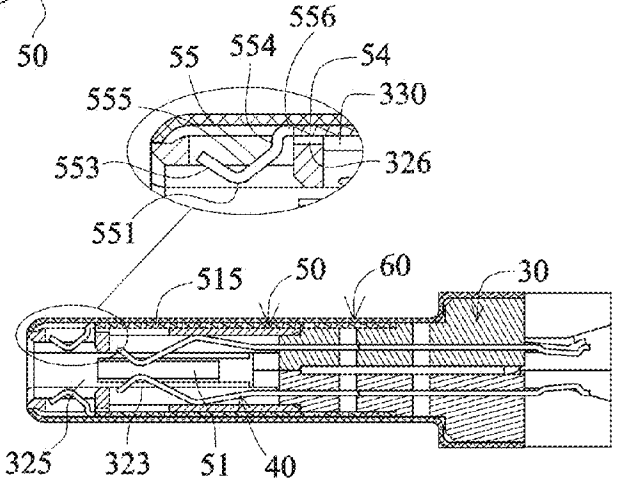
FIG. 55 is a cross-sectional side view according to the 31st embodiment of the invention.

Please refer to FIGS. 54 and 55, the 31st embodiment of the invention is substantially the same as the first embodiment and the 23rd embodiment except for the difference that between the elastic arm 555 and the root 556, which is connected to the elastic contact sheet 55 and the twisted elastic sheet 54 of the metallic inner shell 50 in this embodiment, is provided with a vertical section 554, so that the elastic arm 555 and the root 556 are in a form of a turning step. Thus, the elastic arm 555 is curved to form the smaller inclination for the projecting contact 551. Upon use, the elastic contact sheet 55 prevents the shrinking, kneeing down or falling down.

In addition, the docking part 32 is provided with opening holes 330 corresponding to the two elastic arms 515 of the twisted elastic sheet 54 to provide the twisting gap for the two elastic arms 515. Because the opening hole 330 is directly formed, it can be conveniently manufactured.

Figure 56:
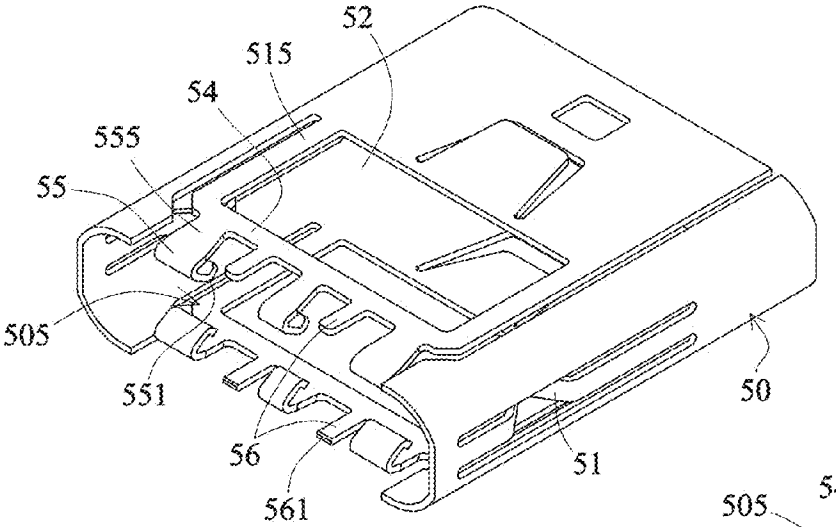
FIG. 56 is a pictorial view showing a metallic inner shell according to the 32nd embodiment of the invention.

Please refer to FIG. 56, the 32nd embodiment of the invention is almost the same as the 23rd embodiment except for the difference that the distal section of the elastic contact sheet 55 of the metallic inner shell 50 of this embodiment is inwardly and reversely bent to form the projecting contact 551, and the front end thereof is a free end and in a form of a guide-in inclined surface 553. Thus, the inclination required for the elastic arm 555 curving to the front end may be smaller. Upon use, the elastic contact sheet 55 prevents the shrinking, kneeing down or falling down.

Figure 57:
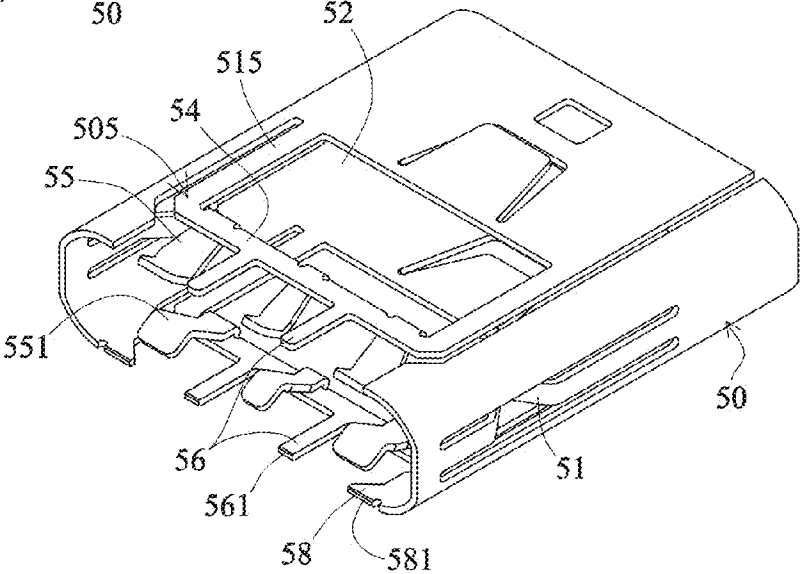
FIG. 57 is a pictorial view showing a metallic inner shell according to the 33rd embodiment of the invention.

Please refer to FIG. 57, the 33rd embodiment of the invention is almost the same as the 23rd embodiment except for the difference that the elastic contact sheet 55 of the metallic inner shell 50 in this embodiment is formed by bending the rear end of the twisted elastic sheet 54 reversely forwards.

Figures 58, 59:
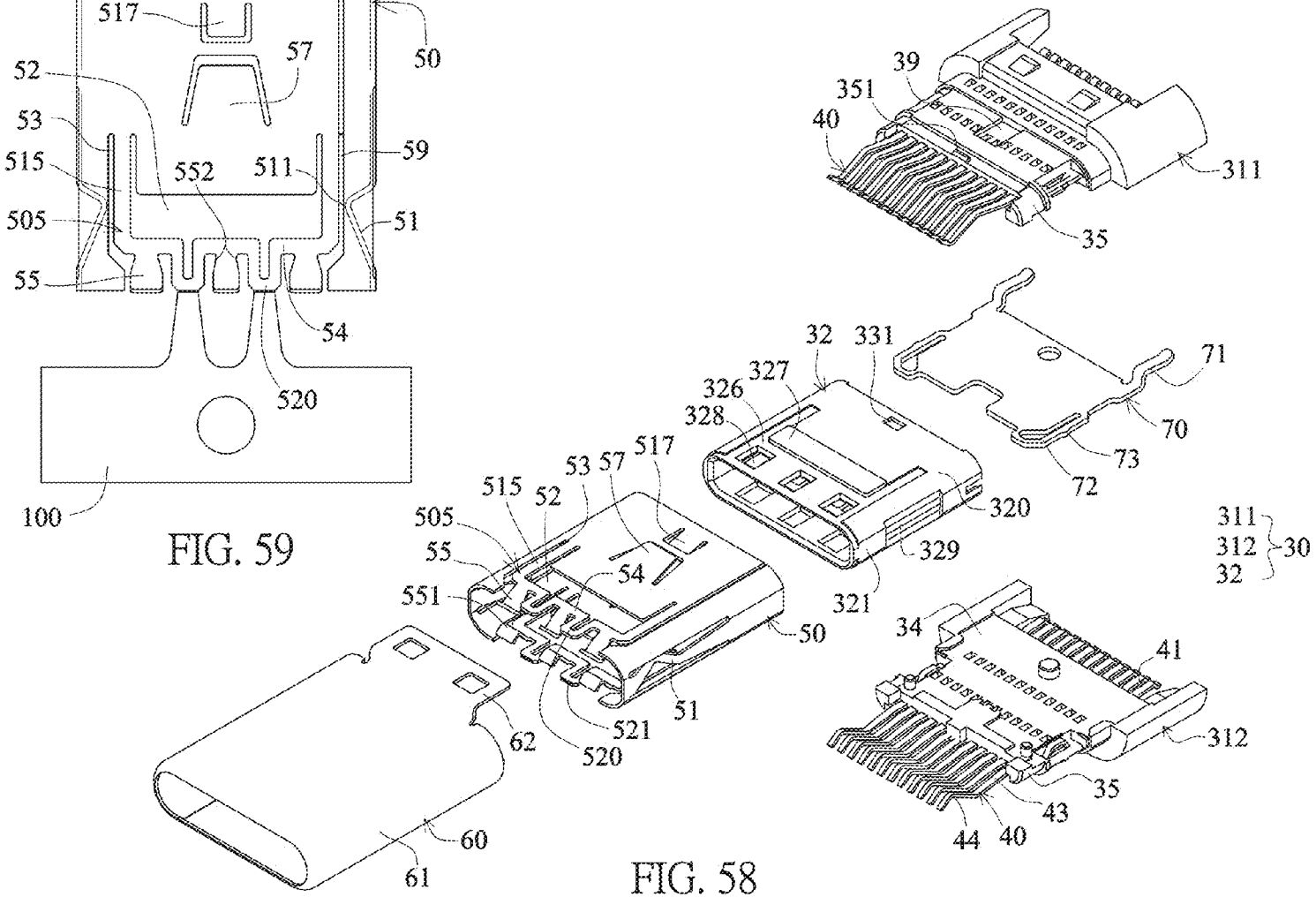
FIG. 58 is a pictorially exploded view according to the 34th embodiment of the invention.
FIG. 59 is a top view showing a metallic inner shell connected to a material tape according to the 34th embodiment of the invention.

Please refer to FIGS. 58 and 59, the 34th embodiment of the invention is almost the same as the first embodiment except for the difference that two ends of the elastic sheets of the two resilient snaps 51 of the metallic inner shell 50 in this embodiment are integrally connected to the left and right side plates. Each of middle sections of the two resilient snaps is provided with a more inwardly projecting snap 511. The width of the elastic sheet of the resilient snap 51 gradually reduces from the front and rear ends to the snap 511, and the inclination of the elastic sheet from the rear end to the snap is greater than the inclination of the elastic sheets from the front end to the snaps, so that the plug can be inserted into the socket more smoothly and can easily push away the resilient snap 51, and the plug upon removing has the larger snapping force due to the larger inclination of the elastic sheet. In addition, the twisted elastic sheet 54 of the twisted contact piece 505 is integrally connected to the three elastic contact sheets 55, the twisted elastic sheet 54 is wound between the two elastic contact sheets 55 and in the form of a U-shaped elastic arm 520, and the U-shaped elastic arm 520 is wound frontwards and the front end thereof is in a form of an electroless layer section 521. So, the twisted elastic sheet 54 is wound to form two U-shaped elastic arms 520. In manufacturing, the front end of the U-shaped elastic arm 520 is connected to a material tape 100, and after the material tape 100 is separated, the electroless layer section 521 is formed.

The twisted elastic sheet 54 is wound to form two U-shaped elastic arms 520 so as to increase the twisted elastic arm of force, and the U-shaped elastic arm is wound frontwards in a manner similar to the twisted supporting elastic sheet 56 of the first embodiment and also has the middle section supporting effect, so that the middle section of the twisted elastic sheet 54 can be supported and cannot become too soft to be twisted and deformed, and the middle elastic contact sheet 55 still has the sufficient normal contact force.

Figure 60:
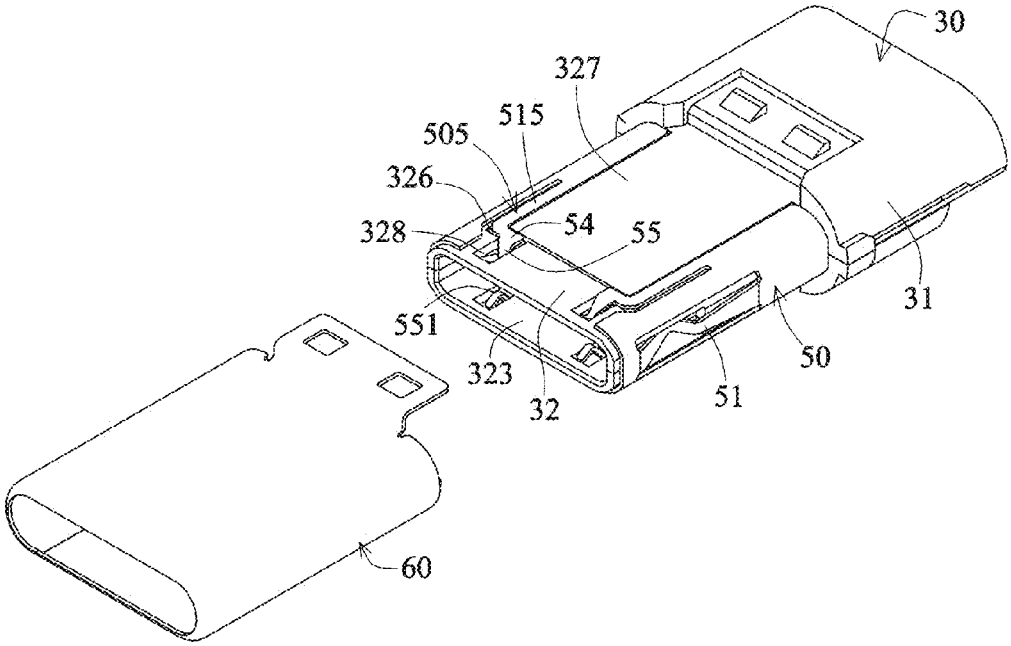
FIG. 60 is a pictorially exploded view according to the 35th embodiment of the invention.
Figure 61:
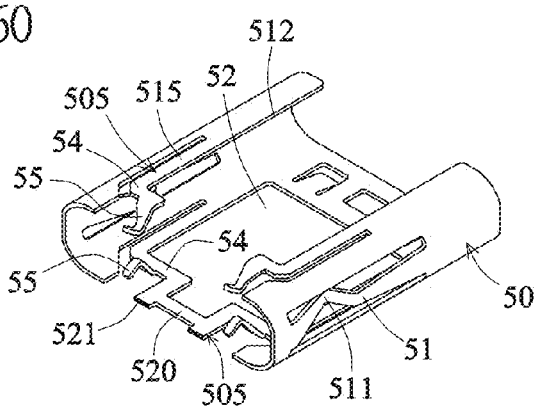
FIG. 61 is a pictorial view showing a metallic inner shell according to the 35th embodiment of the invention.
Figure 62:
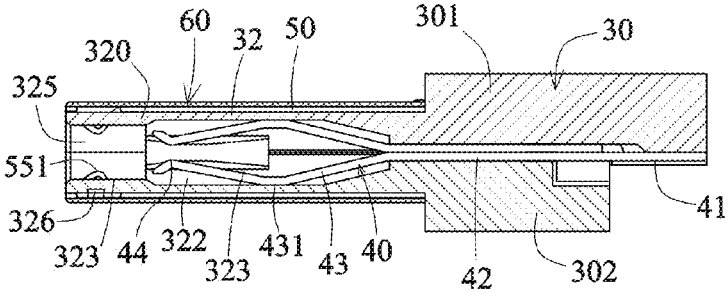
FIG. 62 is a cross-sectional side view according to the 35th embodiment of the invention.

Please refer to FIGS. 60, 61 and 62, the 35th embodiment of the invention is a USB TYPE-C 2.0 electrical connection plug, and is substantially the same as the 17th embodiment and the 29th embodiment except for the difference that this embodiment is similar to the 34th embodiment, wherein the elastic sheets of the two resilient snaps 51 of the metallic inner shell 50 gradually reduce from the front and rear ends to the snap 511, the twisted elastic sheet 54 of the twisted contact piece 505 of the bottom plate is integrally connected to the two elastic contact sheets 55, the twisted elastic sheet 54 is wound between the two elastic contact sheets 55 and in the form of a U-shaped elastic arm 520, the U-shaped elastic arm 520 is wound frontwards and the front end thereof is in the form of two electroless layer sections 521.

Figure 63:
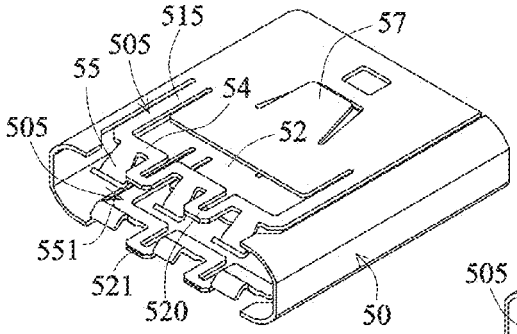
FIG. 63 is a pictorial view showing a metallic inner shell according to the 36th embodiment of the invention.

Please refer to FIG. 63, the 36th embodiment of the invention is substantially the same as the 34th embodiment except for the difference that the left and right side plates of the metallic inner shell 50 in this embodiment are not provided with the resilient snap.

Figure 64:
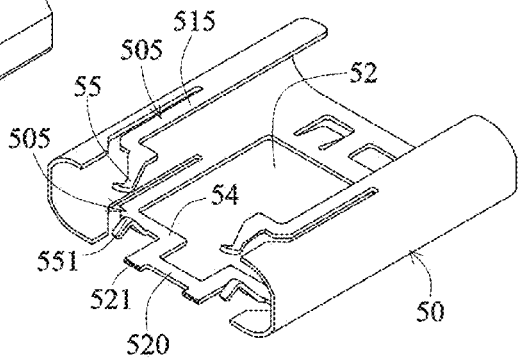
FIG. 64 is a pictorial view showing a metallic inner shell according to the 37th embodiment of the invention.

Please refer to FIG. 64, the 37th embodiment of the invention is substantially the same as the 35th embodiment except for the difference that the left and right side plates of the metallic inner shell 50 in this embodiment are not provided with the resilient snap.

Figure 65:
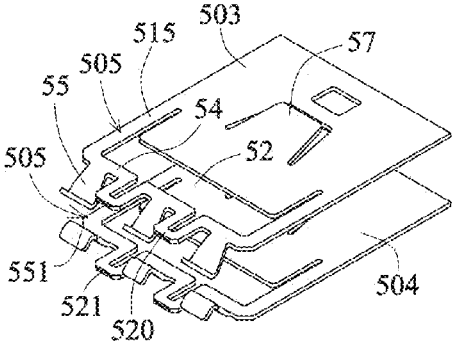
FIG. 65 is a pictorial view showing upper and lower plates according to the 38th embodiment of the invention.

Please refer to FIG. 65, the 38th embodiment of the invention is substantially the same as the 25th embodiment except for the difference that the twisted elastic sheets 54 of the twisted contact pieces 505 of the upper and lower plates 503 and 504 in this embodiment are integrally connected to the three elastic contact sheets 55, the twisted elastic sheet 54 is wound between the two elastic contact sheets 55 and in the form of a U-shaped elastic arm 520, the U-shaped elastic arm is wound frontwards and the front end thereof is in a form of an electroless layer section 521, so that the twisted elastic sheet 54 is wound to form two U-shaped elastic arms 520.

Figure 66:
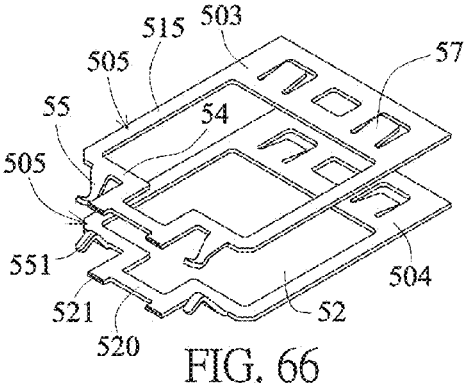
FIG. 66 is a pictorial view showing upper and lower plates according to the 39th embodiment of the invention.

Please refer to FIG. 66, the 39th embodiment of the invention is substantially the same as the 26th embodiment except for the difference that the twisted elastic sheets 54 of the twisted contact pieces 505 of the upper and lower plates 503 and 504 in this embodiment are integrally connected to the two elastic contact sheets 55, the twisted elastic sheet 54 is wound between the two elastic contact sheets 55 and in the form of a U-shaped elastic arm 520, the U-shaped elastic arm is wound frontwards and the front end thereof is in the form of two electroless layer sections 521.

Figure 67:
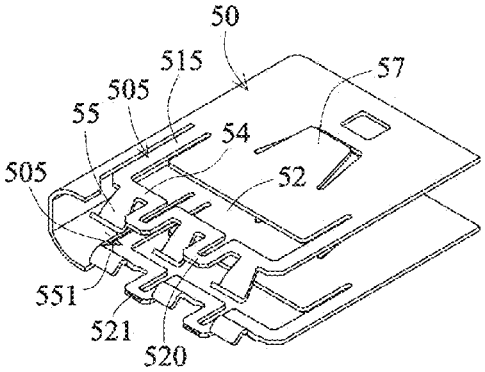
FIG. 67 is a pictorial view showing a metallic inner shell according to the 40th embodiment of the invention.

Please refer to FIG. 67, the 40th embodiment of the invention is substantially the same as the 36th embodiment except for the difference that the left and right sides of the metallic inner shell 50 in this embodiment are only provided with a side plate and in the form of a U shape rotated clockwise by 90 degrees.

Figure 68:
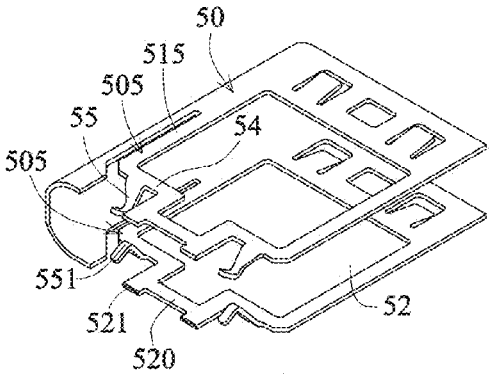
FIG. 68 is a pictorial view showing a metallic inner shell according to the 41st embodiment of the invention.

Please refer to FIG. 68, the 41st embodiment of the invention is substantially the same as the 37th embodiment except for the difference that the left and right sides of the metallic inner shell 50 in this embodiment are only provided with a side plate and in the form of the U shape rotated clockwise by 90 degrees.

Figure 69:
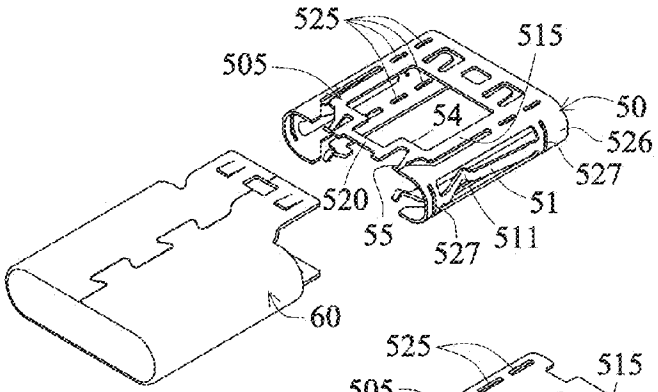
FIG. 69 is a pictorially exploded view showing a metallic inner shell and a metal housing according to the 42nd embodiment of the invention.

Please refer to FIG. 69, the 42nd embodiment of the invention is a USB TYPE-C 2.0 electrical connection plug, and is substantially the same as the 35th embodiment except for the difference that at least one arc tangent portion of left and right sides of the top and bottom plate surfaces of the metallic inner shell 50 of this embodiment is pressed to form at least one through hole 525, so that the arc-shaped left and right side plates 526 can be easily bent. The portions connected to the left and right side plates 526 and the resilient snap 51 are provided with material-pulling punch holes 527 extending in a top-to-bottom direction, so that the resilient snap 51 can be easily drawn from the left and right side plates 526 to prevent the elastic arm of the resilient snap 51 from becoming thin and hard.

Figure 69A:
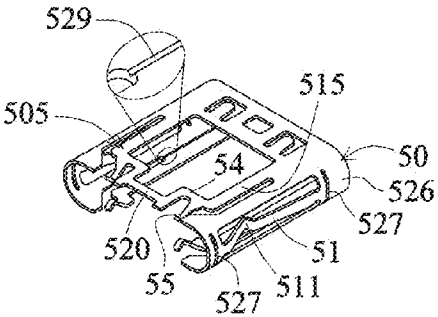
FIG. 69A is a pictorial view showing the metallic inner shell n another implementation according to the 42nd embodiment of the invention.

Please refer to FIG. 69A showing another implementation of the metallic inner shell 50 of this embodiment, at least one arc tangent portion of left and right sides of the top and bottom plate surfaces is not provided with a through hole, but the inner surface has a V-shaped pre-cut groove in a front view along a tangent line, wherein the V-shaped pre-cut groove 529 extends in a front-to-rear direction, so that the arc-shaped left and right side plates 526 can be easily bent.

Figure 70:
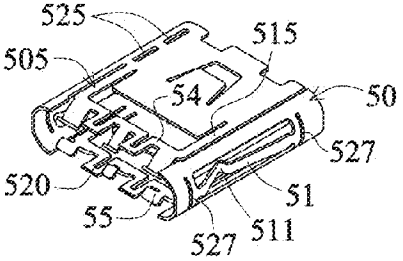
FIG. 70 is a pictorial view showing a metallic inner shell according to the 43rd embodiment of the invention.

Please refer to FIG. 70, the 43rd embodiment of the invention is a USB TYPE-C 3.0 electrical connection plug, and is substantially the same as the 36th embodiment and the 42nd embodiment.

Figure 71:
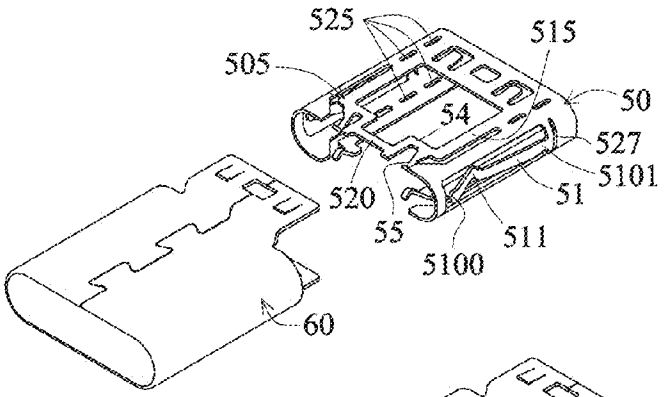
FIG. 71 is a pictorially exploded view showing a metallic inner shell and a metal housing according to the 44th embodiment of the invention.
Figure 72:
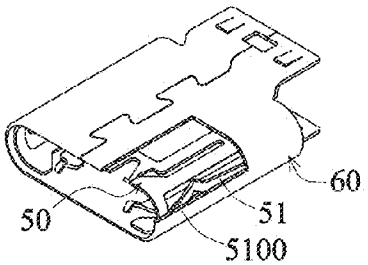
FIG. 72 is a pictorially assembled view showing the metallic inner shell and the metal housing according to the 44th embodiment of the invention.

Please refer to FIGS. 71 and 72, the 44th embodiment of the invention is a USB TYPE-C 2.0 electrical connection plug, and is substantially the same as the 42nd embodiment except for the difference that the rear ends of the resilient snaps 51 of the left and right side plates of the metallic inner shell 50 in this embodiment are roots 5101 connected to the left and right side plates of the metallic inner shell 50, and the front ends thereof are open to form free ends 5100, wherein the free end 5100 rests against the metal housing 60 so that the resilient snap 51 may have the better resilient contact.

Figure 74:
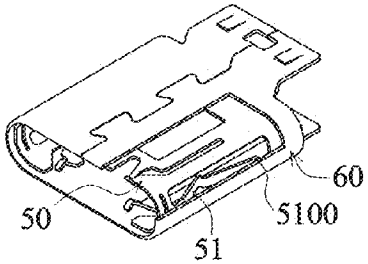
FIG. 74 is a pictorially assembled view showing the metallic inner shell and the metal housing according to the 45th embodiment of the invention.
Figure 73:
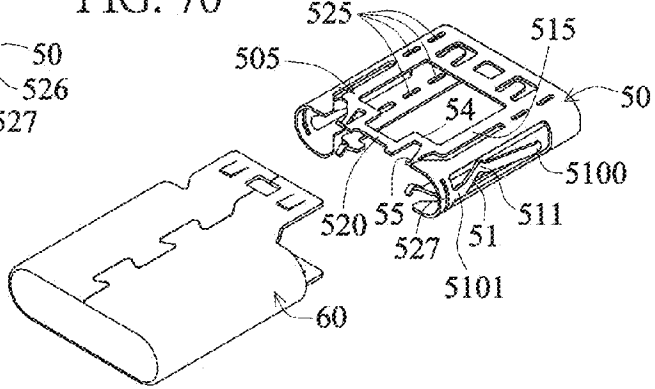
FIG. 73 is a pictorially exploded view showing a metallic inner shell and a metal housing according to the 45th embodiment of the invention.

Please refer to FIGS. 73 and 74, the 45th embodiment of the invention, is a USB TYPE-C 2.0 electrical connection plug, and is substantially the same as the 42nd embodiment except for the difference that the front ends of the resilient snaps 51 of the left and right side plates of the metallic inner shell 50 in this embodiment are roots 5101 connected to the left and right side plates of the metallic inner shell 50, and the rear ends thereof are open to form free ends 5100, wherein the free end 5100 rests against the metal housing 60.

Figure 75:
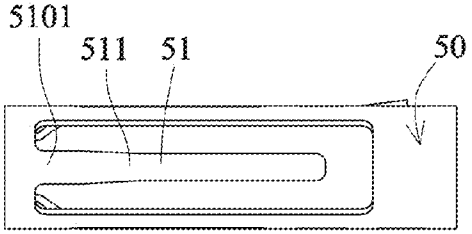
FIG. 75 is a side view showing a metallic inner shell according to the 46th embodiment of the invention.

Please refer to FIG. 75, the 46th embodiment of the invention is a USB TYPE-C 2.0 electrical connection plug or USB TYPE-C 3.0 electrical connection plug, and is substantially the same as the 45th embodiment except for the difference that the plate surfaces of the roots 5101 of the resilient snaps 51 of the left and right side plates of the metallic inner shell 50 this embodiment are wider than the plate surfaces of the snaps 511.

Figure 76:
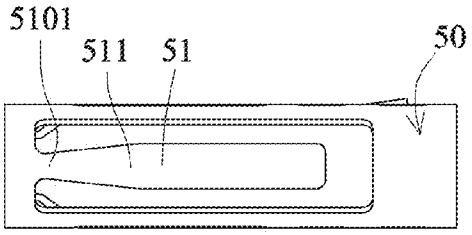
FIG. 76 is a side view showing a metallic inner shell according to the 47th embodiment of the invention.

Please refer to FIG. 76, the 47th embodiment of the invention is a USB TYPE-C 2.0 electrical connection plug or USB TYPE-C 3.0 electrical connection plug, and is substantially the same as the 46th embodiment except for the difference that the plate surface of the root 5101 of the resilient snap 51 in this embodiment is narrower than the plate surface of the snap 511.

Figure 77:
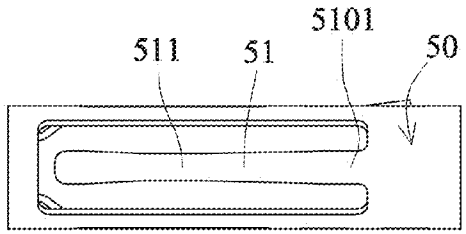
FIG. 77 is a side view showing a metallic inner shell according to the 48th embodiment of the invention.

Please refer to FIG. 77, the 48th embodiment of the invention is a USB TYPE-C 2.0 electrical connection plug or USB TYPE-C 3.0 electrical connection plug, and is substantially the same as the 44th embodiment except for the difference that the plate surfaces of the roots 5101 of the resilient snaps 51 of the left and right side plates of the metallic inner shell 50 this embodiment are wider than the plate surfaces of the snaps 511.

Figure 78:
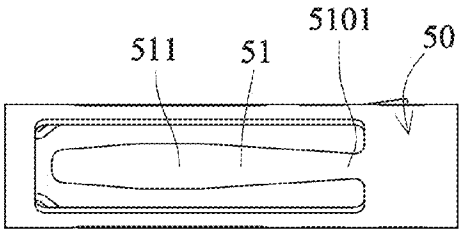
FIG. 78 is a side view showing a metallic inner shell according to a 49th embodiment of the invention.

Please refer to FIG. 78, the 49th embodiment of the invention is a USB TYPE-C 2.0 electrical connection plug or USB TYPE-C 3.0 electrical connection plug, and is substantially the same as the 46th embodiment except for the difference that the plate surface of the root 5101 of the resilient snap 51 in this embodiment is narrower than the plate surface of the snap 511.

Figure 79:
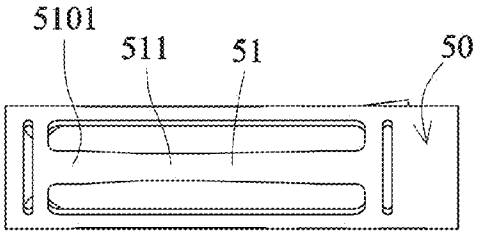
FIG. 79 is a side view showing a metallic inner shell according to a 50th embodiment of the invention.

Please refer to FIG. 79, the invention 50th embodiment is a USB TYPE-C 2.0 electrical connection plug or USB TYPE-C 3.0 electrical connection plug, and is substantially the same as the 42nd embodiment or the 43rd embodiment except for the difference that the plate surfaces of the roots 5101 of the resilient snaps 51 of the left and right side plates of the metallic inner shell 50 in this embodiment are wider than the plate surfaces of the snaps 511.

Figure 80:
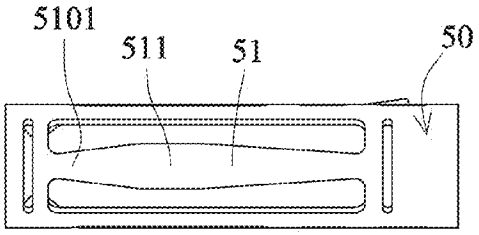
FIG. 80 is a side view showing a metallic inner shell according to the 51st embodiment of the invention.

Please refer to FIG. 80, the invention 51st embodiment is a USB TYPE-C 2.0 electrical connection plug or USB TYPE-C 3.0 electrical connection plug, and is substantially the same as the 50th embodiment except for the difference that the plate surface of the root 5101 of the resilient snap 51 in this embodiment is narrower than the plate surface of the snap 511.

Please refer to FIGS. 81 to 83, the 52nd embodiment of the invention is a USB TYPE-C 2.0 electrical connection plug, and is substantially the same as the 45th embodiment. Similarly, the front ends of the resilient snaps 51 of the left and right side plates of the metallic inner shell 50 are roots 5101 connected to the left and right side plates of the metallic inner shell 50, and the rear ends thereof are open to form free ends 5100 in this embodiment. The difference therebetween is that when the metallic inner shell 50 and the metal housing 60 have not been assembled, the rear section portions in the back of snaps 511 of the resilient snaps 51 of the left and right side plates of the metallic inner shell 50 project beyond the outside of the metallic inner shell 50, as shown in the left phantom lines of FIGS. 81 and 83. Thus, as shown in FIG. 82, when the metallic inner shell 50 is assembled to the docking part 32 of the insulated seat 30 from front to rear, the two resilient snaps 51 are less likely to interfere with the insulated seat 30 and can be easily assembled. As shown in FIG. 83, when the metal housing 60 is further fit with the outside of the metallic inner shell 50, the two resilient snaps 51 are pressed and positioned, so that the snap 511 projects inwardly much more, and the free end 5100 rests against the metal housing 60 in an overpressure manner.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An electrical connector, comprising:

an insulated seat provided with a base seat and a docking part, wherein the docking part is connected to a front end of the base seat, the docking part is provided with two connection plates facing each other in a vertical direction to form a gap, each of opposite facing surfaces of the two connection plates is provided with a connection surface, and a connection slot is formed between the two connection surfaces;

two terminal sets disposed on the insulated seat, wherein each of the terminal sets is provided with at least one row of terminals, the terminal is provided with a fixing portion and an extension, the fixing portion is fixed to the base seat, the extension is connected to a front end of the fixing portion, the extension extends to the connection surface and is provided with a contact projecting beyond the connection surface, the contact is vertically elastically movable, and the contacts of the terminals of the two terminal sets respectively project beyond the two connection surfaces; and a metal housing, which covers the insulated seat and is provided with a four-sided main housing shielding the docking part to form a docking structure, wherein the docking structure may be bidirectionally positioned with one docking electrical connector;

characterized in that a metallic inner shell is further provided between the metal housing and the docking part, the metallic inner shell is fitted with and positioned outside the two connection plates of the docking part and rests against the metal housing, the metallic inner shell is provided with integrally connected upper and lower plates, each of the upper and lower plates is provided with at least one elastic contact sheet, the at least one elastic contact sheet is provided with a projecting contact, which projects beyond the connection surface to the connection slot and is disposed in front of the contact of the terminal, and each of the two connection plates of the docking part is provided with at least one opening through which the contact of the elastic contact sheet passes, wherein each of front sections of the upper and lower plates is integrally provided with at least one twisted contact piece, the twisted contact piece is provided with a twisted elastic sheet extending in a left-to-right direction, the twisted elastic sheet is integrally connected to the elastic contact sheet, one plate surface of the twisted elastic sheet rests against and is in flat surface contact with the metal housing and a twisting space is provided in a direction of another plate surface of the twisted elastic sheet, wherein when the elastic contact sheet is vertically elastically movable, the twisted elastic sheet can be twisted in a direction reverse to an elastically moving direction of the elastic contact sheet through the twisting space.

2. The electrical connector according to claim 1, wherein an elastic arm of the elastic contact sheet extends frontwards and slantingly projects toward the connection slot, and the elastic contact sheet is provided with a projecting contact and has a front end being a free end in a form of a guide-in inclined surface.

3. The electrical connector according to claim 1, wherein two sides of a rear end of the metallic inner shell are provided with backward extending pins, which pass through the base seat of the insulated seat and extend out, wherein the pins of the metallic inner shell may be bonded to a circuit board and grounded.

4. The electrical connector according to claim 1 satisfying one of (a) to (g) or a combination of more than one of (a) to (g):

(a) wherein a width of a root connected to the elastic contact sheet and the twisted elastic sheet is reduced to form two concave portions;

(b) wherein the twisted elastic sheet is disposed on the same plane and integrally connected to and provided with at least one twisted supporting elastic sheet, and the twisted supporting elastic sheet extends frontwards and can be twisted with the twisted elastic sheet;

(c) wherein the twisted elastic sheet is disposed on the same plane and integrally connected to and provided with at least one twisted supporting elastic sheet, the twisted supporting elastic sheet extends frontwards and can be twisted with the twisted elastic sheet, and a front end of the twisted supporting elastic sheet is in a form of an electroless layer section and extends out of the elastic contact sheet;

(d) wherein at least one of the left and right sides of the twisted elastic sheet is connected to an elastic arm extending in a front-to-rear direction;

(e) wherein the twisted elastic sheet is integrally connected to two or three copies of the elastic contact sheet, each of the two connection plates of the docking part is provided with two openings each being the same as the opening or three openings each being the same as the opening through which the contact of the elastic contact sheet passes;

(f) wherein the two connection plates of the docking part are provided with a concave portion for providing a space for twisting of the twisted elastic sheet, the twisted elastic sheet forms the twisting space by the concave portion, and the concave portion is a slot or a through hole; and (g) wherein each of the left and right sides of the twisted elastic sheet is provided with an elastic arm extending in a front-to-rear direction, wherein the two connection plates of the docking part are provided with two slots for providing spaces for twisting of the twisted elastic sheets and two through holes for providing spaces for twisting of the two elastic arms, and the twisted elastic sheets form the twisting space by the slots and the through holes.

5. The electrical connector according to claim 1, wherein each of the front sections of the upper and lower plates of the metallic inner shell is provided with an opening, the two connection plates corresponding to the openings may project thicker to form two convex surfaces and thus to form bouncing spaces for distal ends of the terminals.

6. The electrical connector according to claim 1 satisfying one of (a) to (l) or a combination of more than one of (a) to (l):

(a) wherein the contacts of the two terminal sets have the same contact interface;

(b) wherein the four-sided main housing of the metal housing is top-bottom symmetrical and left-right symmetrical;

(c) wherein the two terminal sets and the insulated seat are embedded with, injection molded with and fixed to each other;

(d) wherein the contacts of the two terminal sets having connection points with the same circuit serial numbers are arranged reversely;

(e) wherein the contacts of the two terminal sets are vertically aligned;

(f) wherein the two connection plates have the same height;

(g) wherein the electrical connector is further provided with a coating for covering a rear section of the metal housing;

(h) wherein the base seat of the insulated seat is provided with the upper and lower base seats directly stacked, the docking part is integrally formed with a rectangularly-shaped fitting frame body and is fit and assembled with the front end of the base seat, and the two terminal sets are respectively fixedly disposed on the upper and lower base seats;

(i) wherein the insulated seat is provided with upper and lower seat bases directly stacked, the upper seat base is integrally provided with an upper base seat and an upper docking part, the lower seat base is integrally provided with a lower base seat and a lower docking part, the upper docking part has an inverse-U shaped frame body, the lower docking part has an U-shaped frame body, the upper and lower docking parts are stacked to form a rectangularly-shaped fitting frame body, and the two terminal sets are respectively fixedly disposed on the upper and lower seat bases;

(j) wherein the docking part is further provided with left and right side plates to form a fitting frame body;

(k) wherein each of the two connection plates is provided with one row of separate bouncing spaces much more depressed than the connection surface and is provided with separation columns for separating the neighboring bouncing spaces, and the extensions of the at least one row of terminals of the two terminal sets respectively extend to the bouncing spaces of two connection surfaces and are vertically elastically movable; and (l) wherein a shape of the docking structure is such that the docking structure can be dual-positionally bidirectionally positioned with one docking electrical connector.

7. The electrical connector according to claim 1 satisfying one of (a) to (b) or a combination of more than one of (a) to (b):

(a) wherein a root of the elastic contact sheet is provided with a vertical section, and the vertical section is connected to the slantingly and forwardly extending elastic arm, so that the elastic arm and the root form a turning step; and (b) wherein a distal section of the elastic contact sheet is inwardly and reversely bent to form the contact.

8. The electrical connector according to claim 1, wherein a middle of the base seat of the insulated seat is provided with a horizontal metal partition plate for separating the two terminal sets from each other, each of the left and right sides of the metal partition plate is provided with a resilient snap, the resilient snap is provided with an elastic arm, the elastic arm is provided a protruding snap projecting toward the connection slot near a free end of the elastic arm, and the two resilient snaps may snap with the docking electrical connector.

9. The electrical connector according to claim 1, wherein a middle of the base seat of the insulated seat is provided with a horizontal metal partition plate for separating the two terminal sets from each other.

10. The electrical connector according to claim 9 satisfying one of (a) to (d) or a combination of more than one of (a) to (d):

(a) wherein the left and right sides of the metal partition plate extend backwards to form pins extending out of the base seat;

(b) wherein two outer terminals of the two terminal sets are ground terminals, and the two ground terminals are provided with projections resting against the metal partition plate;

(c) wherein two outer terminals of the two terminal sets are ground terminals, and the ground terminal is provided with a projection resting against the metallic inner shell; and (d) wherein the left and right sides of the metal partition plate are provided with projections resting against the metallic inner shell.

11. The electrical connector according to claim 1, wherein each of the upper and lower plates of the metallic inner shell is connected and provided with the two elastic contact sheets, a middle section of the upper plate is formed with an opening extending in a front-to-rear direction and only has two side portions, each of the two side portions is connected to the one twisted contact piece, and the twisted contact piece is connected to the one elastic contact sheet.

12. The electrical connector according to claim 11, wherein the twisted elastic sheet of the twisted contact piece of each of two side portions of the upper plate is connected and provided with an elastic arm extending in a front-to-rear direction, the lower plate is only integrally provided with a twisted contact piece, the twisted elastic sheet of the twisted contact piece of the lower plate is integrally connected to the two elastic contact sheets and each of the left and right sides of the twisted contact piece is provided with an elastic arm extending in a front-to-rear direction.

13. The electrical connector according to claim 1, wherein the twisted elastic sheet is integrally connected to at least two elastic contact sheets, and the twisted elastic sheet is wound between the two elastic contact sheets to form a U-shaped elastic arm.

14. The electrical connector according to claim 13 satisfying one of (a) to (c) or a combination of more than one of (a) to (c):

(a) wherein the twisted elastic sheet is integrally connected to two or three copies of the elastic contact sheet;

(b) wherein the front end of the U-shaped elastic arm is in a form of an electroless layer section; and (c) wherein the U-shaped elastic arm is wound frontwards.

15. The electrical connector according to claim 1, wherein each of left and right side plates of the metallic inner shell is integrally projectingly provided with a resilient snap projecting toward the connection slot, the two resilient snaps may snap with the docking electrical connector.

16. The electrical connector according to claim 15 satisfying one of (a) to (i) or a combination of more than one of (a) to (i):

(a) wherein each of top and bottom ends of the left and right side plates of the metallic inner shell is integrally provided with at least one elastic contact sheet, an elastic arm of the elastic contact sheet is provided with a projecting contact, the projecting contact of the elastic contact sheet projects beyond the connection surface to the connection slot and is disposed in front of the contact of the terminal, and each of the two connection plates of the docking part is provided with at least one opening through which the contact of the elastic contact sheet passes;

(b) wherein two ends of elastic sheets of the two resilient snaps are integrally connected to the left and right side plates, each of middle sections of the two resilient snaps is provided with a more inwardly projecting snap, each of the left and right side plates is provided with a material-pulling punch hole extending in a top-to-bottom direction near a portion connected to the resilient snap;

(c) wherein the left and right side plates of the metallic inner shell are formed by pressing a plate surface and are integrally bent to form the resilient snap;

(d) wherein front and rear ends of the two elastic sheets of the two resilient snaps are integrally connected to the left and right side plates, each of the middle sections of the two resilient snaps is provided with a more inwardly projecting snap, and widths of the elastic sheets of the resilient snaps gradually reduce from the front and rear ends to the snap;

(e) wherein the docking part is further provided with left and right side plates to form a fitting frame body, and two side plates of the docking part are respectively provided with two openings through which the two resilient snaps pass;

(f) wherein the two ends of the elastic sheets of the two resilient snaps are integrally connected to the left and right side plates, each of the middle sections of the two resilient snaps is provided with a more inwardly projecting snap, inclinations from two rear ends of the two elastic sheets of the two resilient snaps to the two elastic sheets of the two snaps are greater than inclinations from two front ends of the two elastic sheets of the two resilient snaps to the two elastic sheets of the two snaps;

(g) wherein one of the front and rear ends of the two elastic sheets of the two resilient snaps is integrally connected to the left and right side plates, the other one of the front and rear ends of the two elastic sheets of the two resilient snaps is open to form a free end, each of the two middle sections of the two elastic sheets of the two resilient snaps is provided with a more inwardly projecting snap, and the free end rests against the metal housing;

(h) wherein the two elastic sheets of the two resilient snaps have two front ends integrally connected to the left and right side plates, and two rear ends open to form free ends, each of the two middle sections of the two elastic sheets of the two resilient snaps is provided with a more inwardly projecting snap, and the free end rests against the metal housing in an overpressure manner; and (i) wherein the two elastic sheets of the two resilient snaps have two front ends integrally connected to the left and right side plates, and two rear ends open to form free ends, each of the two middle sections of the two elastic sheets of the two resilient snaps is provided with a more inwardly projecting snap, and the free end rests against the metal housing in an overpressure manner, wherein when the metallic inner shell and the metal housing are not assembled and fitted together, a rear section portion in back of the resilient snap projects beyond the metallic inner shell.

17. An electrical connector, comprising:

an insulated seat provided with a base seat and a docking part, wherein the docking part is connected to a front end of the base seat, the docking part is provided with two connection plates facing each other in a vertical direction to form a gap, each of opposite facing surfaces of the two connection plates is provided with a connection surface, and a connection slot is formed between the two connection surfaces;

two terminal sets disposed on the insulated seat, wherein each of the terminal sets is provided with at least one row of terminals, the terminal is provided with a fixing portion and an extension, the fixing portion is fixed to the base seat, the extension is connected to a front end of the fixing portion, the extension extends to the connection surface and is provided with a contact projecting beyond the connection surface, and the contact is vertically elastically movable, and the contacts of the terminals of the two terminal sets respectively project beyond the two connection surfaces; and a metal housing, which covers the insulated seat and is provided with a four-sided main housing shielding the docking part to form a docking structure, wherein the docking structure may be bidirectionally positioned with one docking electrical connector;

characterized in that between the metal housing and the docking part is further provided with metallic upper and lower plates, the upper and lower plates are separated from each other in a vertical direction and are respectively connected to and positioned outside the two connection plates of the docking part and rest against the metal housing, each of the upper and lower plates is integrally provided with at least one twisted contact piece, the twisted contact piece is provided with a twisted elastic sheet extending in a left-to-right direction, the twisted elastic sheet is integrally connected to at least one elastic contact sheet, the elastic contact sheet is provided with a projecting contact projecting beyond the connection surface to the connection slot and being disposed in front of the contact of the terminal, each of the two connection plates of the docking part is provided with at least one opening through which the contact of the elastic contact sheet passes, a plate surface of the twisted elastic sheet rests against and is in flat surface contact with the metal housing, and a twisting space is provided in a direction of another plate surface of the twisted elastic sheet, wherein when the elastic contact sheet is vertically elastically movable, the twisted elastic sheet can be twisted in a direction reverse to an elastically moving direction of the elastic contact sheet through the twisting space.

18. An electrical connector, comprising:

an insulated seat provided with a base seat and a docking part, wherein the docking part is connected to a front end of the base seat and is provided with at least one connection surface; and a metal housing, which covers the insulated seat and is provided with a four-sided main housing shielding the docking part to form a docking structure, wherein the docking structure may be positioned with one docking electrical connector;

characterized in that the electrical connector is provided with at least one metallic twisted contact piece, the twisted contact piece is positioned at the insulated seat, the twisted contact piece is provided with a twisted elastic sheet extending in a left-to-right direction, the twisted elastic sheet is integrally connected to at least one elastic contact sheet, a plate surface of the twisted elastic sheet rests against and is in flat surface contact with the metal housing, and a twisting space is provided in a direction of another plate surface of the twisted elastic sheet, when the elastic contact sheet is vertically elastically movable, the twisted elastic sheet can be twisted in a direction reverse to an elastically moving direction of the elastic contact sheet through the twisting space, and the elastic contact sheet is provided with a projecting contact projecting beyond the connection surface.

19. The electrical connector according to claim 18 satisfying one of (a) to (j) or a combination of more than one of (a) to (j):

(a) wherein a width of a root connected to the elastic contact sheet and the twisted elastic sheet is reduced to form two concave portions;

(b) wherein the twisted elastic sheet is disposed on the same plane and integrally connected to and provided with at least one twisted supporting elastic sheet, and the twisted supporting elastic sheet extends frontwards and can be twisted with the twisted elastic sheet;

(c) wherein the twisted elastic sheet is disposed on the same plane and integrally connected to and provided with at least one twisted supporting elastic sheet, the twisted supporting elastic sheet extends frontwards and can be twisted with the twisted elastic sheet, and a front end of the twisted supporting elastic sheet is in a form of an electroless layer section;

(d) wherein at least one of the left and right sides of the twisted elastic sheet is connected to an elastic arm extending in a front-to-rear direction;

(e) wherein the twisted elastic sheet is integrally connected to one, two or three of the elastic contact sheets;

(f) wherein the twisted contact piece is a grounding piece;

(g) wherein a shape of the docking structure is such that the docking structure can be dual-positionally bidirectionally positioned with one docking electrical connector;

(h) wherein the at least one twisted contact piece integrally extends and connects to a positioning portion positioned with the insulated seat;

(i) wherein the at least one twisted contact piece integrally extends and connects to a positioning portion positioned with the insulated seat and integrally extends and connects to a pin extending out of the metal housing and the insulated seat; and (j) wherein an elastic arm of the elastic contact sheet extends frontwards and has a front end being a free end in a form of a guide-in inclined surface.

* * * * *